US012649215B2

(12) United States Patent
Eckel et al.

(10) Patent No.: US 12,649,215 B2
(45) Date of Patent: Jun. 9, 2026

(54) REPOSITIONABLE ABRASIVE DISC MOUNTING ASSEMBLY AND METHOD OF USING THE SAME

(71) Applicant: 3M INNOVATIVE PROPERTIES COMPANY, St. Paul, MN (US)

(72) Inventors: Joseph B. Eckel, Vadnais Heights, MN (US); Erin D. Spring, Darien Center, NY (US); Thomas J. Nelson, Woodbury, MN (US); Fay T. Salmon, Eden Prairie, MN (US); Dominic J. Triana, Minneapolis, MN (US); Jonathan J. O'Hare, Woodbury, MN (US); Thomas R.J. Corrigan, St. Paul, MN (US); David T. Buckley, Falcon Heights, MN (US); Cory M. Arthur, Eagan, MN (US); Alireza Ghaderi, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 645 days.

(21) Appl. No.: 18/005,285

(22) PCT Filed: Jul. 1, 2021

(86) PCT No.: PCT/IB2021/055925

§ 371 (c)(1),
(2) Date: Jan. 12, 2023

(87) PCT Pub. No.: WO2022/013670

PCT Pub. Date: Jan. 20, 2022

(65) Prior Publication Data

US 2023/0339073 A1 Oct. 26, 2023

Related U.S. Application Data

(60) Provisional application No. 63/200,277, filed on Feb. 26, 2021, provisional application No. 62/705,714, filed on Jul. 13, 2020.

(51) Int. Cl.
*B24D 9/08* (2006.01)

(52) U.S. Cl.
CPC ..... *B24D 9/085* (2013.01)

(58) Field of Classification Search
CPC ..... B24B 45/00; B24B 45/006; B24B 23/02; B24B 23/022; B24B 23/028;
(Continued)

(56) References Cited

U.S. PATENT DOCUMENTS 2,997,819 A * 8/1961 Schacht ..... B24D 9/085 451/510
3,496,680 A * 2/1970 Hutchins ..... B24B 23/03 451/344

(Continued)

FOREIGN PATENT DOCUMENTS

WO 2021124036 A1 6/2021

OTHER PUBLICATIONS

International Search Report for PCT International Application No. PCT/IB2021/055925, mailed on Nov. 25, 2021, 7 pages.

(Continued)

*Primary Examiner* — Robert F Neibaur
(74) *Attorney, Agent, or Firm* — Katherine M. Scholz

(57) ABSTRACT

A method for repositioning an abrasive disc within a repositionable abrasive disc mounting assembly is presented. The method includes mounting the abrasive disc to a repositionable abrasive disc mounting assembly in a first position. The mounting disc assembly includes the abrasive disc coupled to the back-up pad assembly such that the abrasive disc is in contact with a pressure feature of the back-up pad assembly, a drive shaft of a grinding tool, and a fastener that maintains the position of the abrasive disc and the back-up pad coupled to the drive shaft. The method also includes conducting an abrasive operation by activating the grinding (Continued)

tool. The method also includes re-positioning the abrasive disc, with respect to the repositionable abrasive disc mounting assembly, in a second position. The first position includes the abrasive disc in a first position relative to the pressure feature. The second position includes the abrasive disc in a second position relative to the pressure feature assembly. Re-positioning includes an adjustment between the first and second position while the abrasive disc is still positioned on the drive shaft between the fastener and the back-up pad assembly.

6 Claims, 20 Drawing Sheets

(58) Field of Classification Search
CPC ... B24B 23/005; B24B 41/047; B24B 41/007; B24B 55/00; B24D 7/16; B24D 9/08; B24D 9/085; B24D 13/20; B24D 13/147; B24D 13/18; B24D 5/16; F16D 1/08
USPC ..... 451/510, 359, 509, 342, 344, 521, 490, 451/538, 514, 515, 516
See application file for complete search history.

(56) References Cited

U.S. PATENT DOCUMENTS

| | | | | |
|---|---|---|---|---|
| 4,683,683 | A * | 8/1987 | Block | B24D 9/085 451/521 |
| 6,743,085 | B2 * | 6/2004 | Fritz | B24B 45/006 451/308 |
| 7,731,573 | B2 | 6/2010 | Rivard et al. | |
| 10,926,375 | B2 * | 2/2021 | Laforest | B24B 7/186 |
| 2015/0283675 | A1 * | 10/2015 | Campana | B24D 9/08 451/521 |
| 2016/0214234 | A1 * | 7/2016 | Sato | B24D 9/08 |
| 2016/0354900 | A1 * | 12/2016 | Fontes Da Rocha Castro | B24B 55/10 |
| 2018/0369982 | A1 * | 12/2018 | Yamauchi | B24B 23/02 |

OTHER PUBLICATIONS

Communication from Examining Division, EP21739794, dated Nov. 20, 2025, 8 Pages.

* cited by examiner

REPOSITIONABLE ABRASIVE DISC MOUNTING ASSEMBLY AND METHOD OF USING THE SAME

CROSS REFERENCE TO RELATED APPLICATIONS

This application is a national stage filing under 35 U.S.C. 371 of PCT/IB2021/055925, filed Jul. 1, 2021, which claims the benefit of U.S. Provisional Application No. 63/200,277, filed Feb. 26, 2021 and U.S. Provisional Application No. 62/705,714, filed Jul. 13, 2020, the disclosure of which is incorporated by reference in its/their entirety herein.

BACKGROUND

Abrasive fiber discs typically have an abrasive layer on a vulcanized fiber backing. In one common use, an abrasive fiber disc having a central arbor hole is mounted to a back-up pad that is driven by a rotating power shaft of an angle grinder. The back-up pad allows the operator to exert pressure toward a workpiece being abraded while mitigating any deformation of the disc. Some such back-up pads have raised ridges that can localize pressure against adjacent portions of the disc, resulting in increased abrading rate. However, uneven wear of the abrasive disc may result, and the disc may be discarded with some portions of the abrasive layer still in usable condition.

SUMMARY

It is presently discovered that rotationally repositioning an abrasive fiber disc after a period of use so that worn areas of the abrasive layer are no longer adjacent to the ribs of the back-up pad, and lesser worn areas are placed adjacent to the ribs, can substantially increase the performance by increasing the amount of material removed by the abrasive fiber disc during its lifetime, thereby reducing cost to the user and reducing waste.

A method for repositioning an abrasive disc within a repositionable abrasive disc mounting assembly is presented. The method includes mounting the abrasive disc to a repositionable abrasive disc mounting assembly in a first position. The mounting disc assembly includes the abrasive disc coupled to the back-up pad assembly such that the abrasive disc is in contact with a pressure feature of the back-up pad assembly, a drive shaft of a grinding tool, and a fastener that maintains the position of the abrasive disc and the back-up pad coupled to the drive shaft. The method also includes conducting an abrasive operation by activating the grinding tool. The method also includes re-positioning the abrasive disc, with respect to the repositionable abrasive disc mounting assembly, in a second position. The first position includes the abrasive disc in a first position relative to the pressure feature. The second position includes the abrasive disc in a second position relative to the pressure feature assembly. Re-positioning includes an adjustment between the first and second position while the abrasive disc is still positioned on the drive shaft between the fastener and the back-up pad assembly.

Features and advantages of the present disclosure will be further understood upon consideration of the drawings and detailed description as well as the appended claims

Figure 1A:
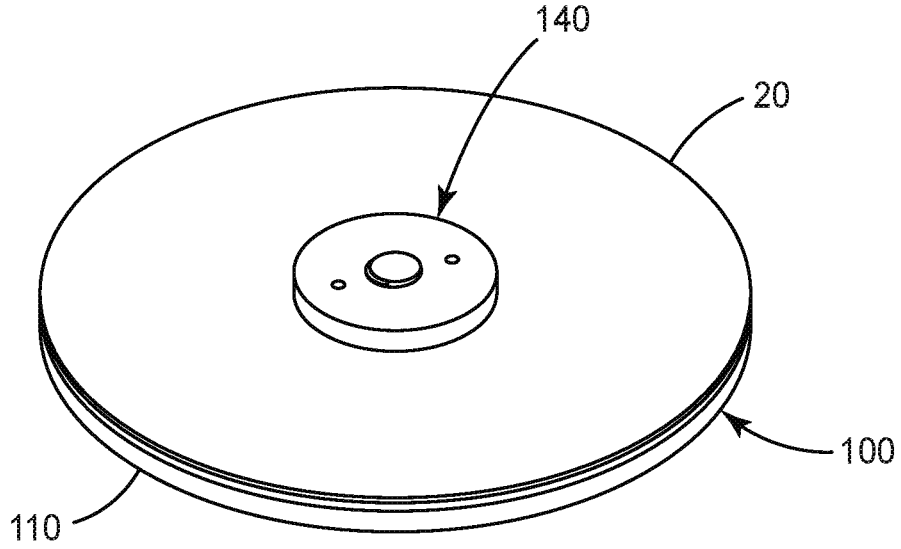
FIGS. 1A-1B are a schematic perspective view of repositionable abrasive disc mounting assemblies retaining an abrasive disc and mounted on a drive shaft of a power tool.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Many configurations of the repositionable abrasive disc mounting assembly are possible, depending, for example, on the particular clamp and fastener configurations.

As used herein:

the term "inwardly facing" means that it is at least inwardly facing, but may also be outwardly facing in addition; and the term "outwardly facing" means that it is at least outwardly facing in part, but may also be inwardly facing in addition;

the term "more worn" means a region having more apparent wear than adjacent regions; and the term "less worn" refers to a region having less apparent wear (also including no wear) than adjacent regions.

In the embodiments below, it will be recognized that the various fastening members can be one half of any suitable reclosable fastening devices including, for example, a friction-fit fastener, a threaded shaft or post coupled with a threaded bore or nut; a spring-ball locking fasteners (snap-on fasteners); or a bayonet mount. Likewise, projections from the back-up pads may have any shape, including, for example, arcuate ribs, spokes, islands, or posts.

Components of the repositionable abrasive disc mounting assembly should be made of appropriately durable materials. Examples include engineering plastics (e.g., nylons, polyphenylene sulfide, polyether ketone, polyether ether ketone, polycarbonate, high density polyethylene, high density polypropylene), polymer composites, metals, ceramic composites, and combinations thereof.

Figure 1B:
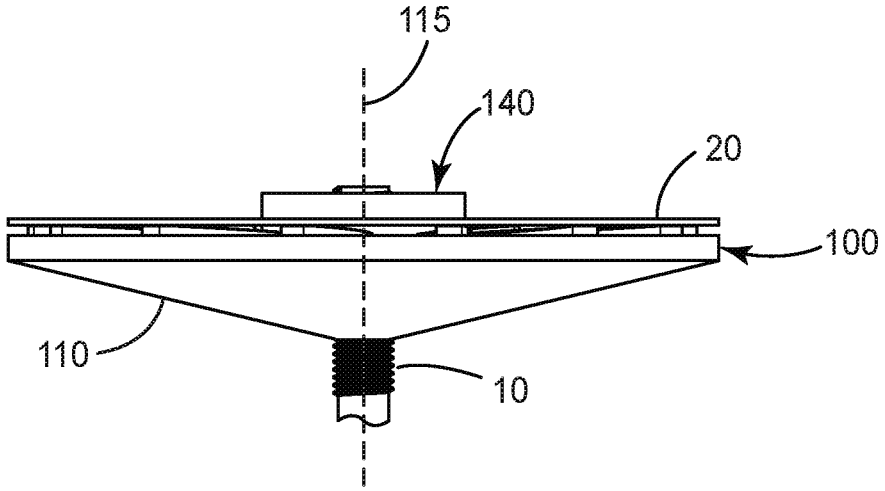

Referring now to FIGS. 1A-1C, repositionable abrasive disc mounting assembly 100 comprises a back-up pad 110 and a fastener 140 that secures an abrasive disc 20. Repositionable abrasive disc mounting assembly 100 includes an outwardly facing centrally disposed fastening member 130 (shown as a threaded bore, see FIG. 4) that is adapted to engage a threaded drive shaft 10 of a power tool (not shown) such as, for example, an angle grinder. The back-up pad 110 has ribbed projections that provide added support to abrasive disc 20. During abrading of a workpiece, the drive shaft 10 rotates around a rotational axis of use (115). Over time, the abrasive disc may typically experience uneven disc wear. If that occurs, the clamp assembly may be unfastened from back-up pad 110 and repositioned in a discrete orientation such that the ribbed projections 118 are beneath portions of the abrasive disc that have less wear. The clamp assembly is then re-secured to the backup member before continuing to abrade the workpiece.

While FIGS. 1A and 1B illustrate a single back-up pad 110, it is expressly contemplated that, in some embodiments, back-up pad 110 actually comprises two components, as illustrated in FIG. 1C, specifically a back-up pad plate 112, which may be a replaceable component, and a back-up pad hub 114, which connects directly to a drive shaft. The entire back-up pad assembly may be coupled together by a top nut 140. As illustrated in FIG. 1C, the back-up pad plate 112 provides a flat surface for receiving an abrasive article 20.

As illustrated herein, many back-up pads have ribs or other raised features that are designed to impart areas of high unit pressure to abrasive disc 20. This provides greater abrasive power to those areas and, as a result, the areas of the abrasive disc 20 in direct contact with back-up pad features will wear faster. The back-up pad features may also result in an increased unit pressure 'footprint' larger than the features themselves, for example creating an applied pressure gradient in a larger area than the direct contact area. It is desired to have a system that rotates, or otherwise moves an abrasive article 20 with respect to a back-up pad such that the features engage new areas of the disc.

Some embodiments herein provide systems that, upon operator engagement, cause some rotation of the areas of high unit pressure on the back-up pad with respect to the abrasive disc, causing features to interact with a new area of the abrasive disc. Other embodiments herein provide systems that, during an abrasive operation or between abrasive operations, will automatically adjust a relative position of an abrasive article with respect to the pressure features on a back-up pad. Some embodiments herein cause relative positions of the pressure features on a back-up pad and the abrasive article to change in discrete increments. Other embodiments herein allow for continuous, or non-discrete, incremental changes between the pressure features on a back-up pad and the abrasive article.

Figure 2:
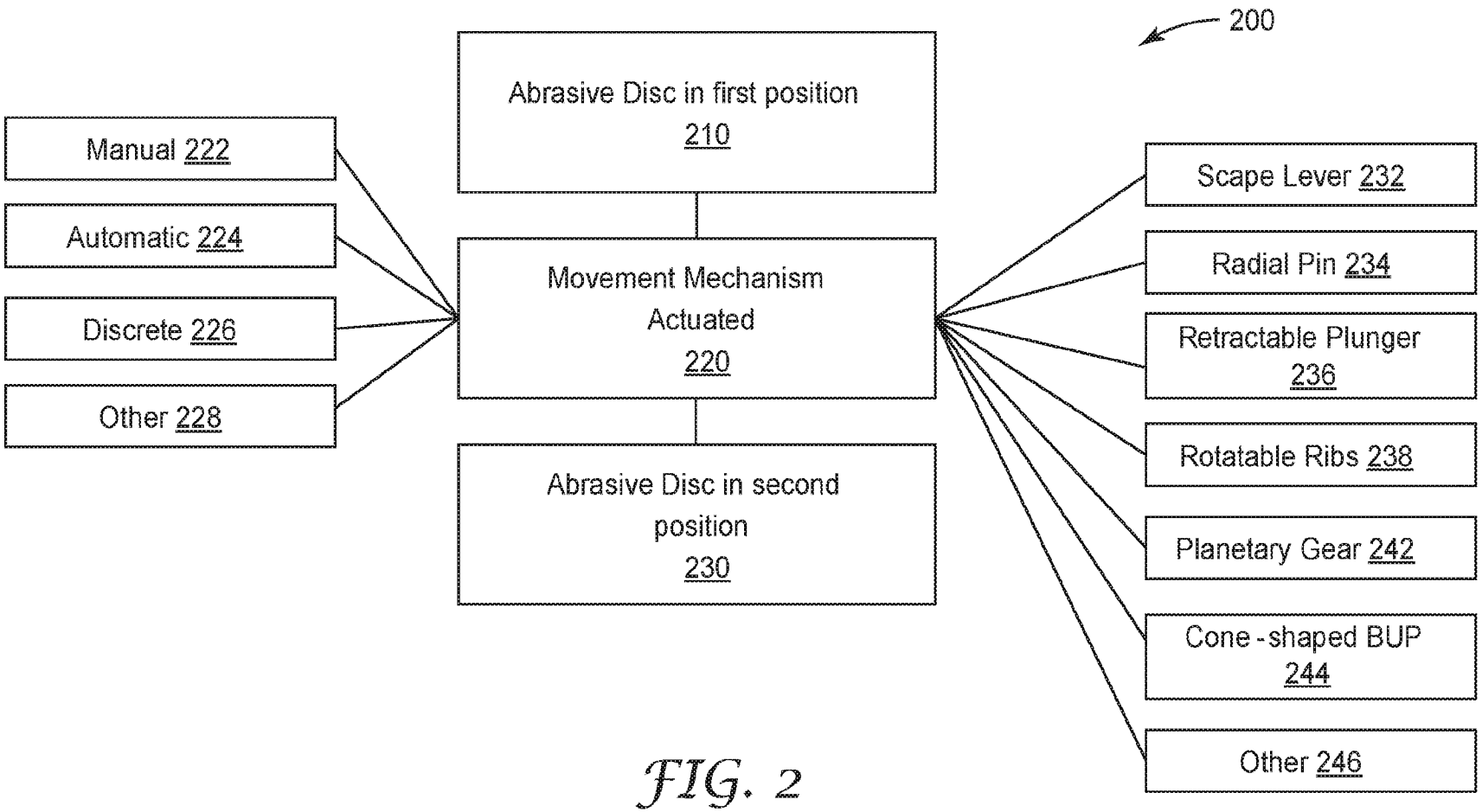
FIG. 2 illustrates a method of abrading a worksurface in accordance with embodiments herein.

FIG. 2 illustrates a method of abrading a workpiece with an abrasive tool in accordance with embodiments herein. A power tool may have a threaded drive shaft that engages a back-up pad assembly, such as assembly 100, which is coupled to an abrasive article, such as an abrasive disc.

In a first position, as indicated in block 210, the back-up pad assembly includes raised features that engage the abrasive disc in specific areas, imparting higher pressure in a pattern that reflects the geometry of the raised features. Because this results in faster wear in the area of the disc covered by the pattern, it is desired to adjust the relative positioning of the abrasive disc with respect to the raised features as the disc is used. Traditionally, this has involved undoing the back-up pad assembly, for example removing the nut and repositioning the abrasive article on the back-up pad before reassembling the nut. This requires tools and takes time that an operator cannot also spend abrading a workpiece.

In block 220, a movement mechanism is actuated that causes a position of the abrasive disc to change from the first position, in block 210, to a second position, in block 230. In some embodiments, the movement mechanism is actuated with manual intervention by the operator, as indicated in block 222. On other embodiments, the movement mechanism is actuated automatically, as indicated in block 224, for example based on a period of time from a previous actuation, or is triggered by the abrasive operation itself. The movement mechanism may move the abrasive article to the second position 230, which may be discretely distanced from the first position 210, as indicated in block 226, in some embodiments. In other embodiments, the movement mechanism moves an abrasive disc continuously during an operation, or allows the abrasive disc to slip in a non-discrete manner, as indicated by block 228.

Actuating a movement mechanism allows the abrasive disc to be positioned such that the ribs, or other raised features of the back-up pad, are moved from more worn regions of position 210 to less worn regions of position 230.

Many different mechanisms may be suitable for causing movement from first position 210 to second position 230. Some may include one or more scape levers 232, one or more radial pins 234, a retractable plunger 236, one or more rotatable ribs 238, one or more planetary gears 242, or the use of a cone-shaped back-up pad 246. However, method 200 may also be suitable accomplished with other mechanisms 246.

Figure 3A:
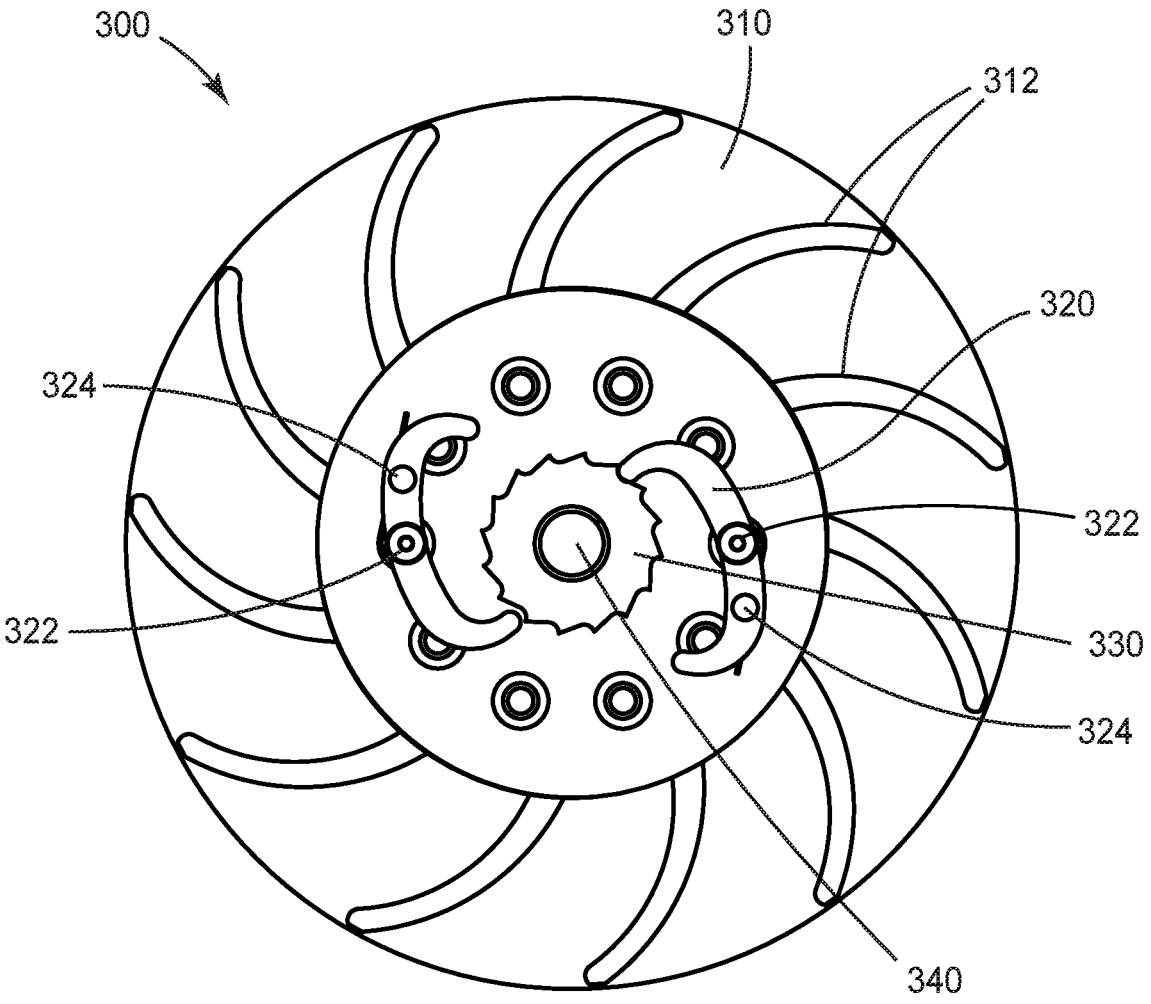
FIGS. 3A-3B illustrate a repositionable abrasive disc mounting assembly utilizing scape levers in accordance with embodiments herein.
Figure 3B:
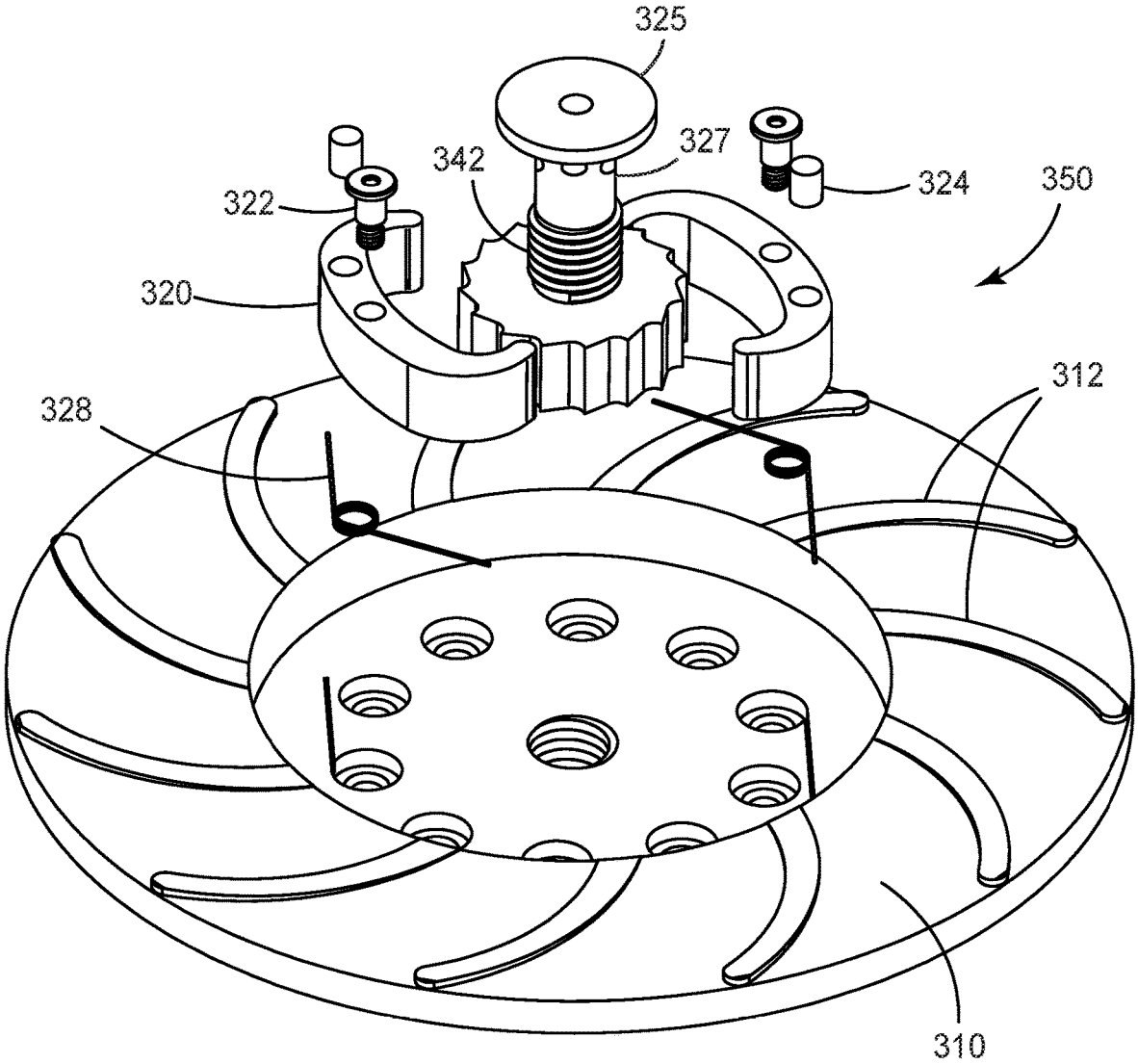

FIGS. 3A-3B illustrate a repositionable abrasive disc mounting assembly utilizing scape levers in accordance with embodiments herein. A back-up pad plate 310 is illustrated with a plurality of raised features 312 spaced evenly about a circumference of plate 310. Two scape levers 320 are illustrated in FIG. 3, positioned around a gear 330. Scape levers 320 may have a spring return 328, or another suitable return mechanism. A fastener 340, such as a top nut, keeps the assembly in position on a drive shaft of a power tool. However, in some embodiments, gear 330 may be sufficient to keep 300 assembly in position on a power tool drive shaft.

Fastener 340 includes threads 342 that engage with corresponding threading to secure the back-up pad assembly 300 to a driveshaft. Fastener also includes bearings 325, 327 that allow the disc assembly to rotate freely. Bearings 325 allow the assembly to rotate freely. Bearings 325, in one embodiment, are situated in a slotted portion of gear 330 (not shown).

As centripetal force acts on scape levers 320, for example as a user turns on a power tool, causing scape levers 320 to engage with gear 330, which is coupled to rib plate 310 as illustrated in FIG. 3A. The scape levers 320 are then locked in place at an operating speed. When force is released, such as when a user turns off the power tool, scape levers 320 disengage from gear 330. Rib plate 310 is then free to move to another tooth location of the gear 330 when a user restarts the machine. System 300, therefore, automatically adjusts a discrete position of raised features 312 with respect to an abrasive disc, in between each abrasive operation, e.g. each time a power tool is activated.

The scape levers may be asymmetrically loaded, as illustrated in FIGS. 3A-3B, with weights 324 with respect to a driveshaft to ensure rotation in a specific direction. The scape levers being inertially loaded upon startup requires that the mass distribution of the levers themselves be asymmetric about the axis of lever rotation so that they rotate in the intended direction. Specifically, as noted in FIG. 3A, loads 324 are placed on each scape lever 320 spaced apart from a connector 322 which secures the entire scape lever to the BUP assembly.

FIG. 3A illustrates scape levers 320 in an inertially loaded position. As scape levers 320 trip outward, the teeth on gear 330 move into the path of scape levers 320. In the illustrated embodiments, scape levers 320 can move forward a discrete number of teeth at a time. In the illustrated embodiments, scape levers 320 are designed to move forward each cycle of force application. The amount of teeth moved forward may be adjusted, based on a selected scape lever design and applied return force. The movement may be a fully defined, indexed move determined by the geometry of the scape lever(s) span and central gear 330 teeth.

When not inertially loaded, a spring keeps another portion of the scape lever engaged at low RPM, which reduces the period of disengagement when the lever adjusts position. This prevents a significant difference in relative rotational velocity between the rib plate and the disc assembly during an abrasive operation.

In one embodiment, gear 330 is a pawl gear and scape levers 320 are ratchet scape levers. FIG. 3A illustrates a pawl gear 330 with 12 gear teeth, however more or fewer teeth may be present, in other embodiments. For example, as few as 6, or as few as 8, or as few as 10 gear teeth may be present on a pawl gear 330, in other embodiments. Additionally, more gear teeth, such as 14, 16, 18 or 20 may be present, in other embodiments. In other embodiments, even more gear teeth may be present, such as 30, 40, 50, 60, 70, 80, 90 or even 100. In other embodiments, even more gear teeth may be present, such as 200, or 300, or 400, or up to 500, or more.

FIGS. 3A-3B illustrates a unidirectional design for a repositionable abrasive disc mounting assembly 300, however it is expressly contemplated that other designs are also possible. Additionally, FIGS. 3A-3B illustrate scape levers 320 with return springs, however it is also contemplated that other mechanisms may be suitable, such as a flexure arm, which may not require a return spring. In some embodiments, the flexure arm has a large distributed area for gripping.

FIG. 3B illustrates an exploded view 350 of abrasive disc mounting assembly 300.

Figure 4A:
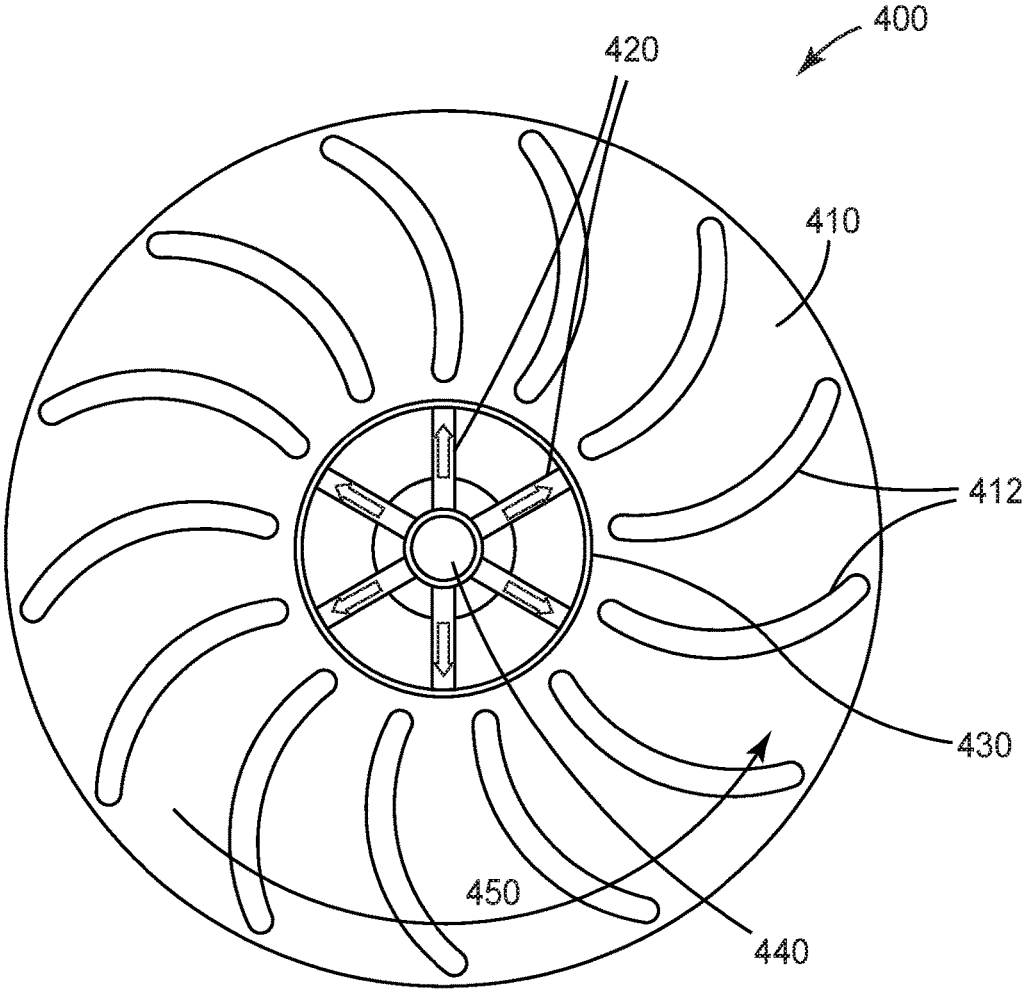
FIGS. 4A-4B illustrate a repositionable abrasive disc mounting assembly utilizing radial pins in accordance with embodiments herein.
Figure 4B:
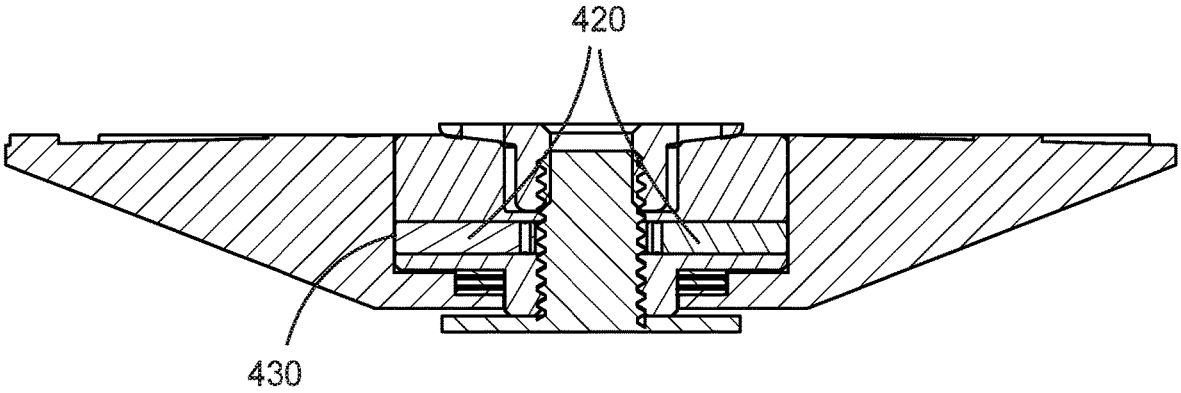

FIGS. 4A-4C illustrate a repositionable abrasive disc mounting assembly utilizing radial pins in accordance with embodiments herein. FIG. 4A illustrates a top-down view of assembly 400, FIG. 4B illustrates a cutaway view of assembly 400, and FIG. 4C illustrates an exploded view of assembly 400.

Disc mounting assembly system 400 includes a back-up pad 410 with a plurality of raised features 412. System 400 is configured to receive an abrasive disc and rotate in the direction indicated by arrow 450. The abrasive disc and components of system 400 are held in place on a drive shaft of a power tool by a nut or other fastener 440.

System 400 is configured to automatically shift a relative position of back-up pad (or plate) 410 with respect to an abrasive disc using a plurality of pins that radially extend from a center of plate 410 and engage with a pin receiving feature 430. As illustrated in FIGS. 4A-4C, a pin receiving feature 430 is a friction surface that causes the pins to lock in place as centripetal force is applied. However, other mechanisms, such as bumps on an interior surface, an uneven interior surface or pockets that receive pins 420 are also expressly contemplated. Pins 420 may be spring loaded pins, such that a force is applied that urges them toward pin receiving feature 430.

Illustrated in FIGS. 4A-4C is an embodiment with six cylindrical pins. However, it is expressly contemplated that more, or fewer pins, could be present. For example, only two, three, four or five pins may be present, providing embodiments that would allow for more frequent, or easier, slipping between relative positions of plate 410 with respect to an abrasive disc. Additionally, a greater number of pins, such as 8, 10, 12, 15 or more pins may also be present, which may make for more difficult, or shorter slip distance between relative positions of plate 410 with respect to an abrasive disc. Further, while cylindrical pins are illustrated, other shapes are expressly contemplated, including those with polygonal cross-sections, increasing or decreasing cross-sections along a length of the pin, or other suitable embodiments.

System 400, in some embodiments, includes an abrasive disc secured to a driveshaft of a power tool while back-up plate 410 is allowed to rotate freely relative to the driveshaft/disc assembly. Inertial loading of the elements in a driven central hub allows for some random slipping before a lock is present between the disc and the hub to the back-up pad. This slipping occurs within the first few tens of milliseconds of a tool start up. Indexing of the disc relative to the back-up pad is, in some embodiments, not readily noticeable by a user of the tool.

However, while FIGS. 4A-4C illustrate embodiments where pin extend from a drive shaft, the opposite embodiment, including pins extending from BUP plate to a friction surface on drive shaft, is also envisioned.

Additionally, while pins 420 are illustrated and described herein, any suitable inertia loaded element may be suitable.

Embodiments herein envision a variety of suitable engaging surfaces 430, including the same material as plate 410, which may be formed of a material that can frictionally engage pins 420. In other embodiments, friction surface 430 is the same material as plate 410, but with a different surface finish, for example with roughness, scoring or bumps induced, or not worn away during processing. Similarly, friction surface 430 may also, in some embodiments, comprise a different material from BUP plate 410. Any material that experiences a lock up when subject to sufficient acceleration would be suitable.

As illustrated herein, a friction surface 430 provides for some random, non-discrete movement of BUP plate 410 with respect to an abrasive disc. However, in some embodiments, instead of, or in addition to, a friction surface, a plurality of pockets may be present within BUP plate 410 that can receive one or more pins 420, providing for discrete relative positions of BUP plate 410 with respect to an abrasive article.

In some embodiments, pins 420 also include a return element that urges the pins from drive shaft toward BUP plate 410, while allowing pins to move back away from BUP plate 410. Pins 420 may be spring-loaded, in some embodiments. In other embodiments, an elastomeric ring is present around the pins 420. Other suitable return elements are also envisioned.

Figure 5A:
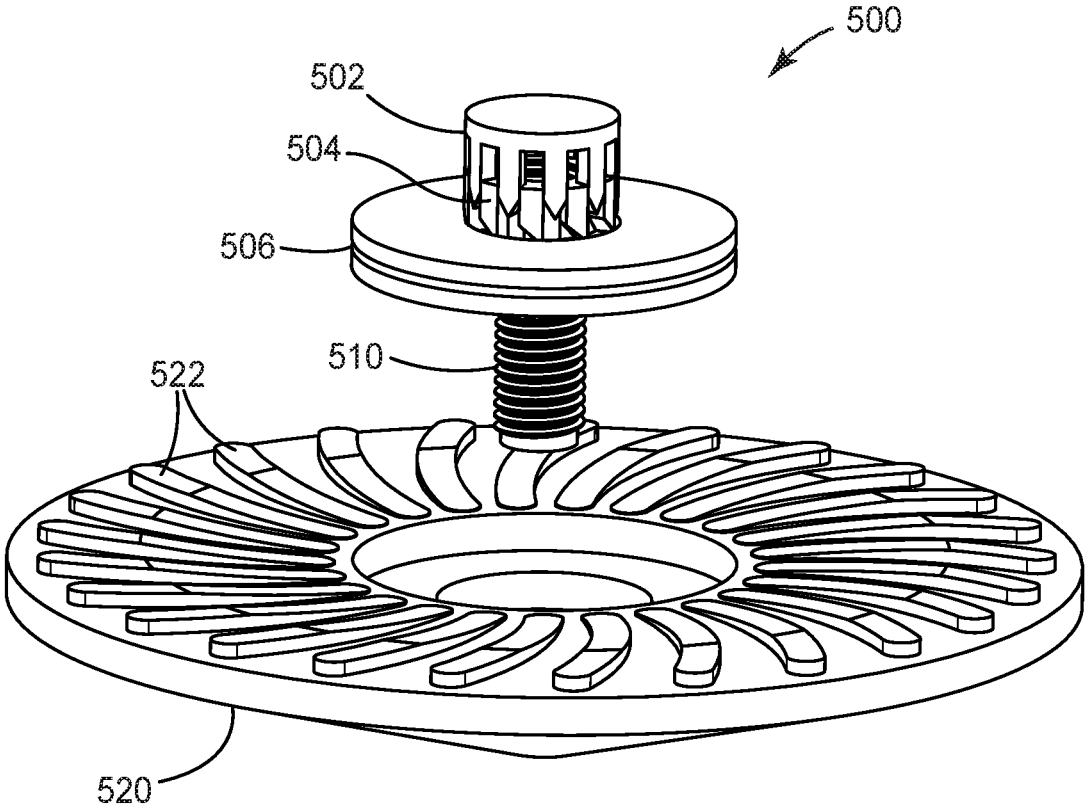
FIGS. 5A-5C illustrate a repositionable abrasive disc mounting assembly utilizing a retractable plunger in accordance with embodiments herein.
Figure 5B:
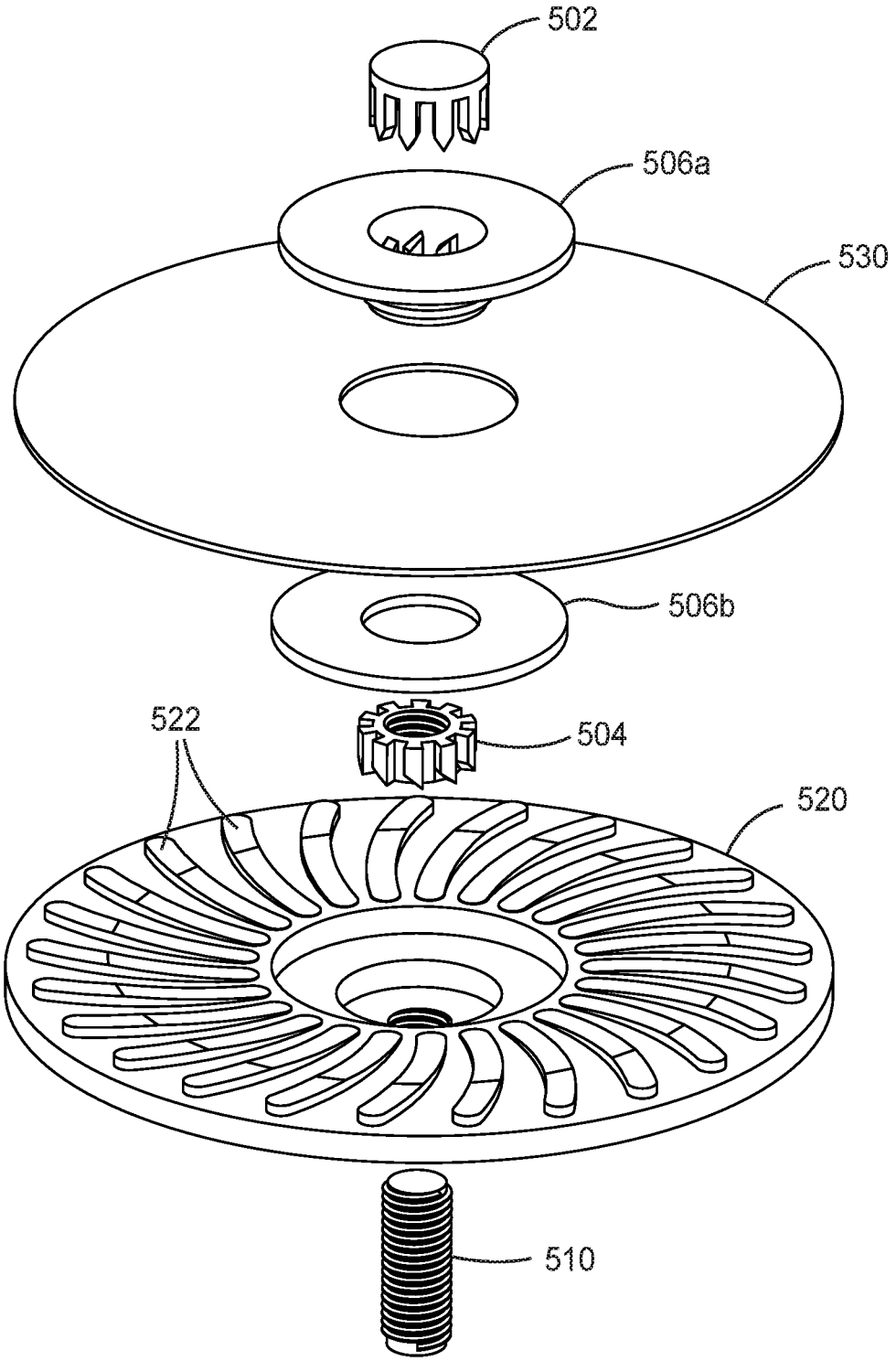
Figure 5C:
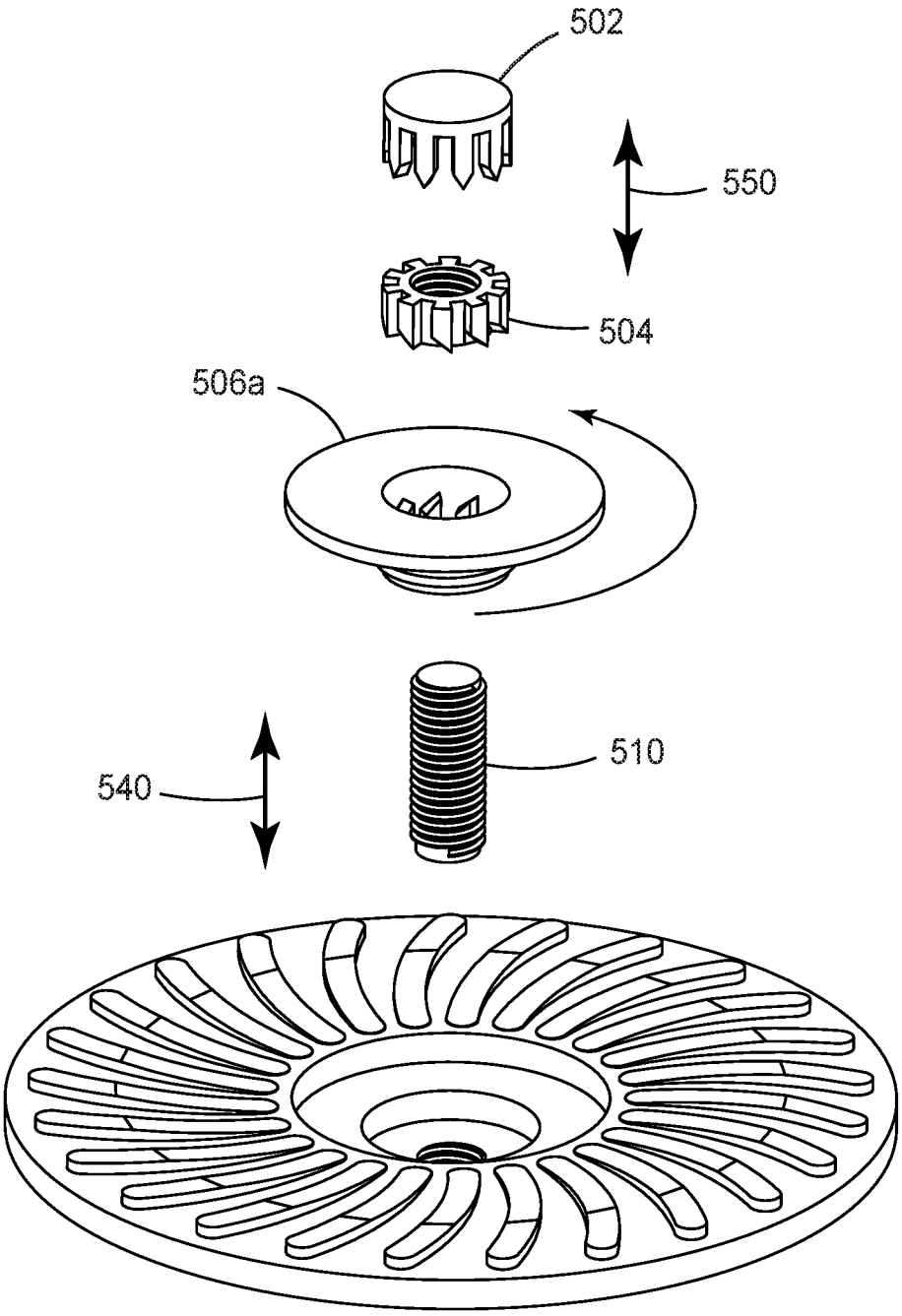

FIGS. 5A-5C illustrate a repositionable abrasive disc mounting assembly utilizing a retractable plunger in accordance with embodiments herein. The retractable plunger may function similarly to a retractable pen, which works by bringing an angled plunger portion into to contact with a similarly angled cam portion until it is free to slide past a stop member into a new position. Ballpoint pens, for example, use this change of angular position of the cam body to lock the pen into either the extended writing position or the non-extended storage position. As illustrated in FIGS.

5A-5C, a similar concept can be applied to discretely rotate an abrasive disc with respect to a pressure feature of a back-up pad assembly attached to a plunger shaft.

As illustrated in FIG. 5A, a backup pad assembly 500 includes a plunger 502 that interacts with a stop member 504 to cause a rotation feature 506 to rotate. As illustrated in FIG. 5A, rotating feature 506 moves between discrete positions around a driveshaft 510. An abrasive article 530, as illustrated in FIG. 5B, can be positioned within rotating member features 506*a*, 506*b*, with a top rotating member feature 506*a* engaging with rotating member feature 506*b*. Feature 506*b* may be a threaded washer, in some embodiments. However, other fasteners may also be suitable such as an unthreaded washer or a clamping nut, for example. Such an interface may allow for an abrasive disc 530 to be easily replaced from assembly 500 by removing stop member 504 from drive shaft 510 and then removing abrasive disc 530 and washer 506*b* before inserting a new abrasive disc.

When an operator engages plunger 502, it causes rotation of rotation member 506 such that an abrasive disc 530 is in a different position relative to pressure features 522 of a back-up pad 520.

While one embodiment of a back-up pad 520 is illustrated, with protruding, curved pressure features 522 and threading in the center, it is expressly contemplated that, in other embodiments, back-up pad 520 includes a plurality of parts secured together.

Abrasive disc 530, in one embodiment, is secured by a disc-securing assembly that includes the upper rotating feature 506*a*, which may be a bolt with outer threading, and a lower feature 506*b*, which may be a washer.

The actuation assembly includes the threaded shaft 510, the stop member 504, which may be a nut that threads onto shaft 510, and plunger 502, which may be secured to stop member 504 by a spring force (550 illustrated in FIG. 5C), or other feature that keeps plunger 502 and stop member 504 separate absent an operator-applied force.

Plunger 502 activates rotation of abrasive disc 530 relative to back-up pad assembly 500 when it is actuated. In one embodiment, like a pen-click, actuation includes depressing the plunger. This presses rotating feature 506*a* down so that it disengages from stop member 504. A second spring force (540 illustrated in FIG. 5C) is present pushing rotating features 506*a,b* upwards, toward stop member 504. As rotating member 506*a* clears the interface with stop member 504, it slides against the angled face of plunger 502, rotating relative to stop member 504. When plunger 502 is released, rotating member 506*a* engages with stop member 504 in a new relative position.

Figure 6A:
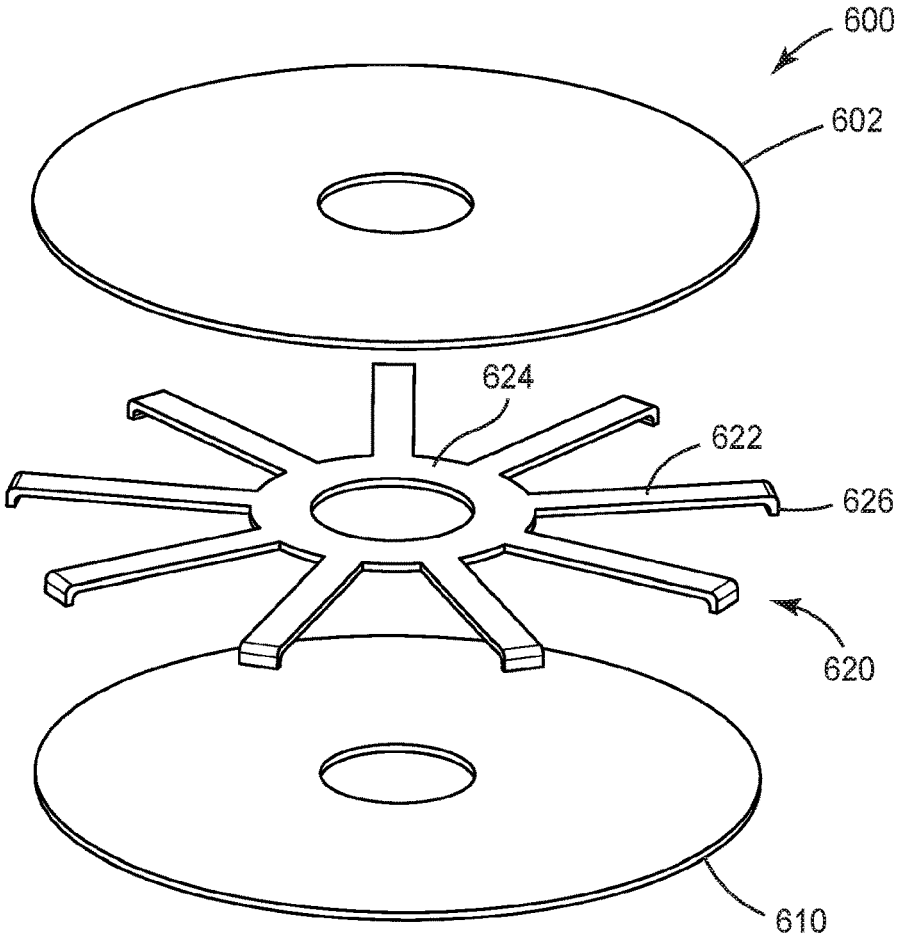
FIGS. 6A-6B illustrate a repositionable abrasive disc mounting assembly utilizing rotatable ribs in accordance with embodiments herein.
Figure 6B:
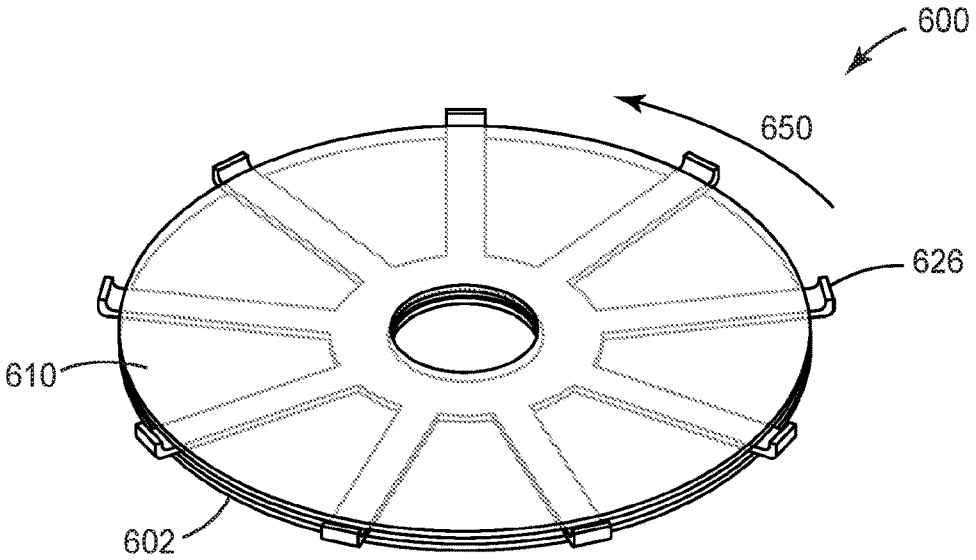

FIGS. 6A-6B illustrate a repositionable abrasive disc mounting assembly utilizing rotatable ribs in accordance with embodiments herein. FIG. 6A illustrates an exploded view, and FIG. 6B illustrates a perspective view of system 600. System 600 may be adjustable by an operator in between abrasive operations. System 600 includes an abrasive disc 602 attached to a back-up pad 610 on a drive shaft with a rotating rib feature 620 in between. Rotating rib feature 620 is illustrated as having nine individual ribs 622 extending from a center ring 624. Each arm also includes a tab 626 that, as illustrated in FIG. 6B, extends beyond an edge of the back-up pad 610 and fiber disc 602. To change a relative position of arms 622 on fiber disc 602, an operator engages a tab 626 and rotates it, for example as indicated by arrow 650. In embodiments where ribs feature 620 is a single solid feature, engaging one tab 626 will cause all arms 622 to move simultaneously. An operator can thus adjust a position of rib feature 620 with respect to fiber disc 602, exposing new areas of the disc 620 to high pressure during a next use.

A mobile feature placed behind a disc 602 to increase its wear life is not new, for example as illustrated in U.S. Pat. No. 2,990,661, issued on Jul. 4, 1961 to Donald Hacket. However, the present design allows for an operator to control where the new areas of high-pressure usage are, and does not require disassembly of system 600 to do so. By engaging and moving tabs 626, an operator has control over when to adjust the relative position of rib feature 620 with respect to fiber disc 602, and how far to move ribs 622.

Rib feature 620 may be made of any suitably rigid material including metal or plastic. Additionally, while a single rigid feature 620 is illustrated, it is expressly contemplated that center ring 624 may allow for arms 622 to be moved individually or to experience some slippage on their own during use.

As illustrated in FIGS. 6A-6B, back-up plate 610, rib feature 620 and abrasive disc 602 are freely moveable with respect to each other. When fastened to a power tool drive shaft under pressure, all three will move together, with substantially no drag. Repositioning of rib feature 620 requires a physical force, by an operator, on one or more tabs 626.

Figure 7A:
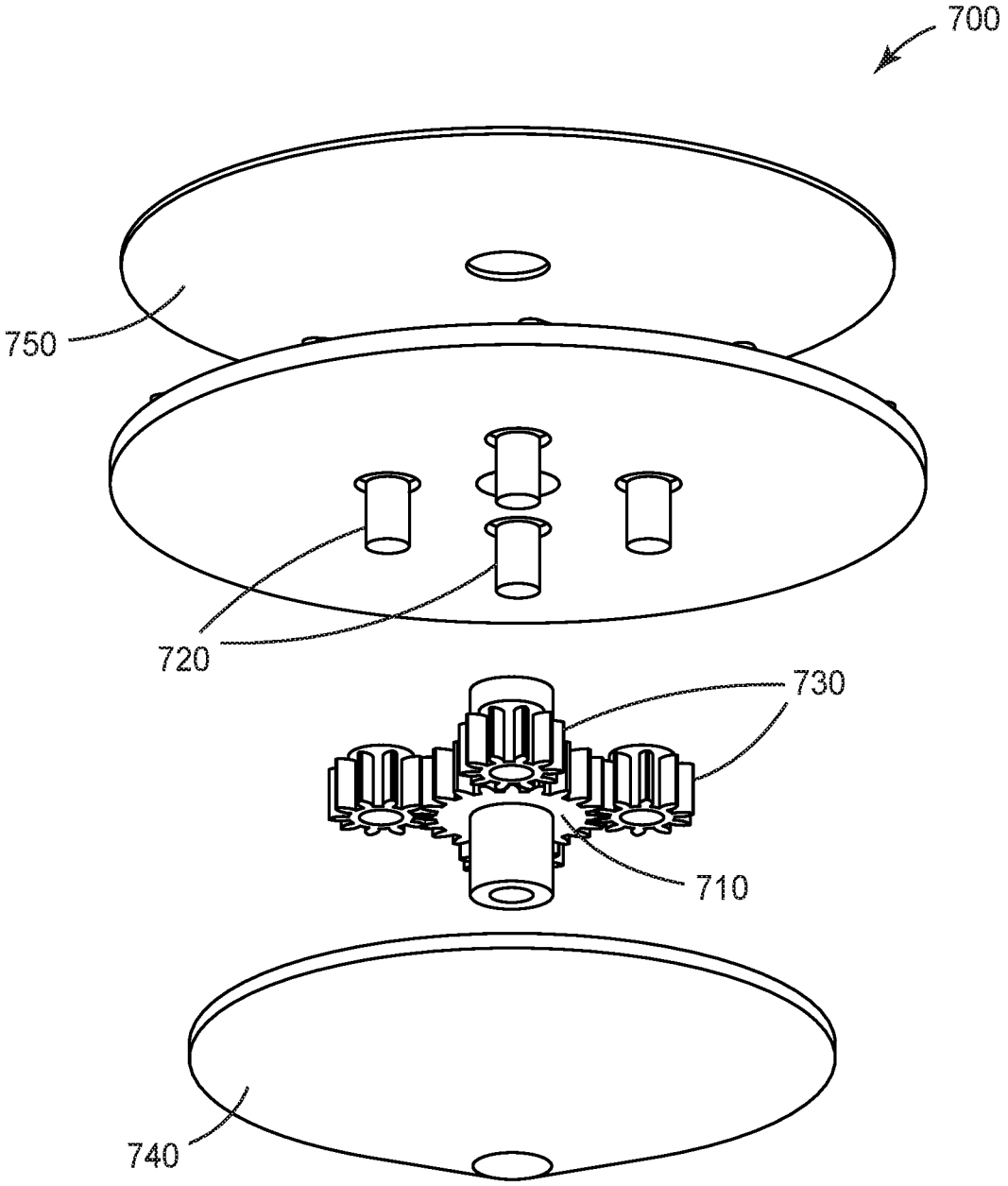
FIGS. 7A-7B illustrates a planetary gear design for a repositionable abrasive disc mounting assembly in accordance with embodiments herein.
Figure 7B:
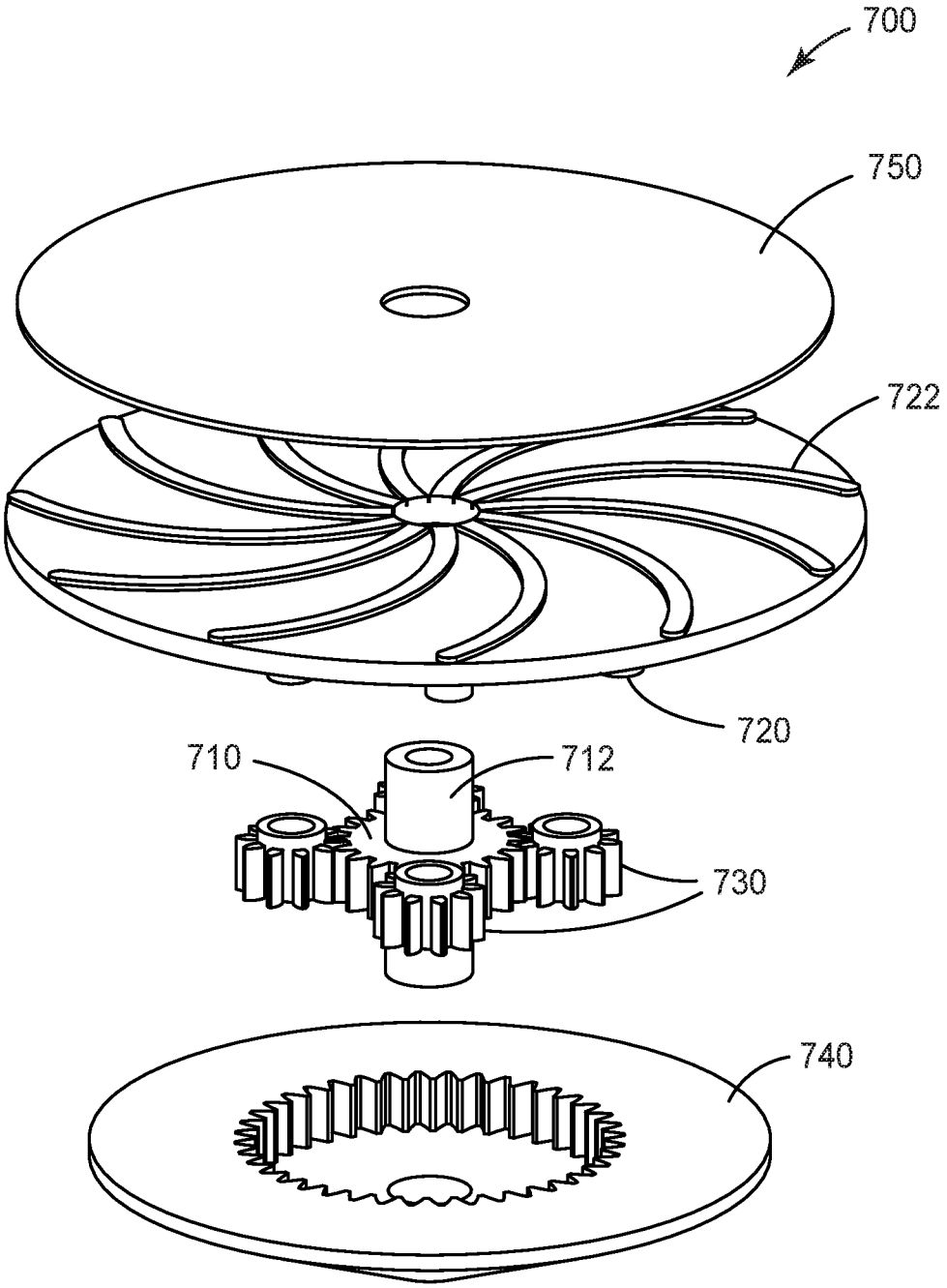

FIGS. 7A-7B illustrate exploded views of a planetary gear design for a repositionable abrasive disc mounting assembly 700 in accordance with embodiments herein. Planetary gears include different sets of gears with different degrees of freedom, resulting in natural rotational differences between components coupled to different portions of the gear assembly. The gear assembly includes a main gear 710, which couples to a drive shaft 712, planetary gears 730, which orbit main gear 710 and also interact with a ring gear 740 which, as shown in the embodiment of FIG. 7B, is built into the backup pad assembly. Ring gear 740, in one embodiment, is physically attached to the body of a power tool. A planetary gear system 700 requires at least one of the components to be attached to a 'ground'—which, as described herein, is the power tool. This allows for controlled rotation between shaft 712 and ring gear 740. A top surface of ring gear 740 includes a bearing that allows for grinding forces to be applied directly from the tool.

Planetary gears 730 also receive, and cause motion of backup pad 722, which causes pressure features to move at a different rate than the rate of rotational movement of abrasive disc 730, which is coupled directly to drive shaft 712. Main gear 710 drives movement of planetary gears 730, which drive movement of a back-up pad through connectors 720. A drive shaft is coupled to main gear 710, and a BUP plate 740 is coupled to, or integrally formed with, a ring gear. An operator couples an abrasive disc to the shaft 712. This results as a mismatch in rotational speed of the abrasive disc and the back-up pad and, consequently, pressure features 724. For example, the fiber disc and tool may be spinning, with the main gear 710, at 1 rpm, and the planetary gears 730 cause pressure features 724 to spin at a speed other than 1 rpm. The mismatch may not be significant enough to be immediately noticeable by an operator, but enough to slowly change the relative position of raised features of a back-up pad with respect to an abrasive article. For example, the mismatch may be a 0.1% speed mismatch, a 0.2% speed mismatch, a 0.3% speed mismatch, a 0.4% speed mismatch, a 0.5% speed mismatch, a 1% speed mismatch, a 2% speed mismatch, a 3% speed mismatch, a 4% speed mismatch, a 5% speed mismatch, or more. In one embodiment, a 4% relative rotational velocity is achieved with around 300 teeth on the main gear 710. Different speed mismatches can be achieved using more, or fewer, teeth on main gear 710, as well as more or fewer than four planetary gears. For example, there may be as few as three planetary gears 730, or as many as five planetary gears 730, or as many as six planetary gears 730. Main gear 710 may have as few as at least about 50 teeth, or at least about 100 teeth, or at least about 150 teeth, or at least about 200 teeth, or at least about 250 teeth, or at least about 350 teeth, or at least about 400 teeth, or at least about 500 teeth.

In some embodiments, system 700 is configured to achieve sufficient relative angular speed between the back-up pad and the abrasive disc while keeping this relative motion low enough to minimize friction between the disc and the back-up pad. This can be achieved through the number of gears, teeth, and size of the gears in the planetary gear system.

FIGS. 8A-8G illustrate a repositionable abrasive disc mounting assembly utilizing precession in accordance with embodiments herein. FIGS. 8A-8G illustrate an assembly with an added component that induces precession. Precession is defined as a change in the orientation of the rotational axis of a rotating body. As used herein, precession refers to the process whereby, as a grinding operation happens, a relative position of high and low pressure areas on an abrasive disc changes. Described herein with respect to FIGS. 2-7 are a plurality of embodiments where higher and lower pressure areas can be changed manually or automatically in between grinding operations, or as a result of a power tool turning on or off. In contrast, the embodiments of FIGS. 8A-8G illustrate mechanisms by which the areas of higher and lower pressure can change during a grinding operation.

Figure 8A:
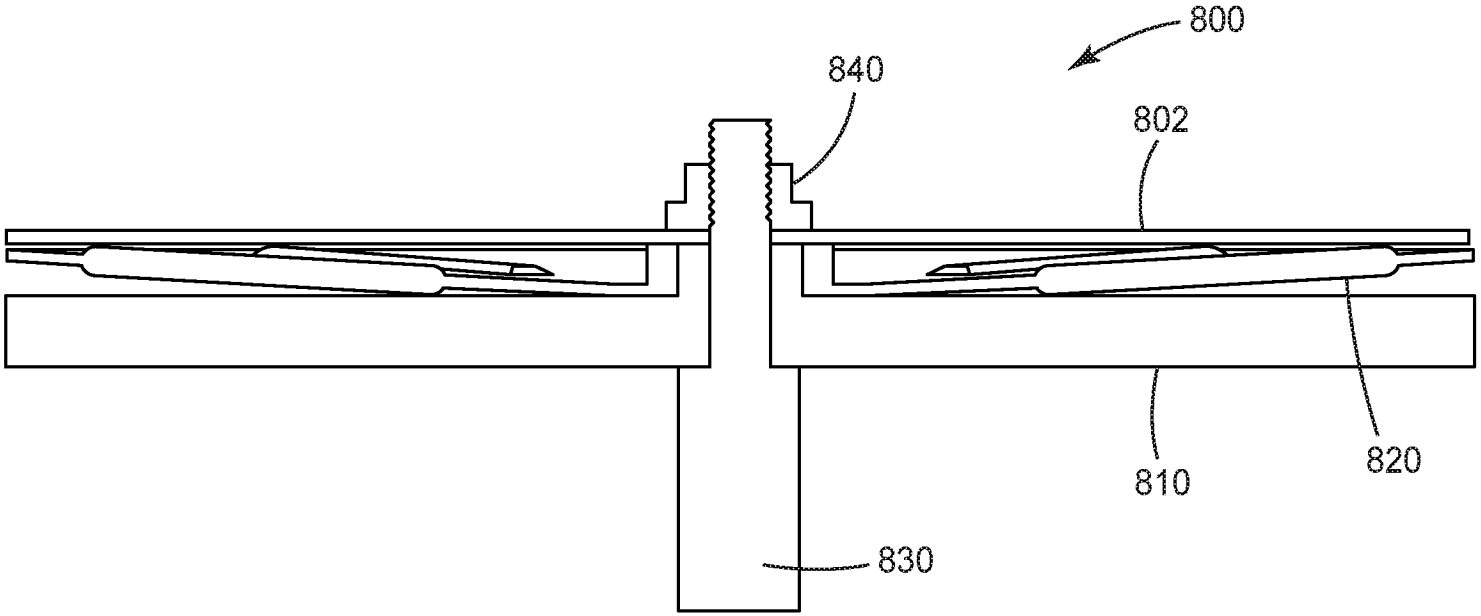
FIGS. 8A-8G illustrate a repositionable abrasive disc mounting assembly utilizing precession in accordance with embodiments herein.

FIG. 8A illustrates an embodiment of a repositionable abrasive disc mounting assembly 800 in which a conical pressure pad 820 is inserted between an abrasive disc 802 and a back-up plate 810. Conical pressure pad 820 is illustrated as having an angular gap present between pad 820 and plate 810. A drive shaft 830 receives backup plate 810, conical pressure pad 820, and abrasive disc 802, which are secured in place by a fastener 840, illustrated as a top nut in FIG. 8A.

Figure 8B:
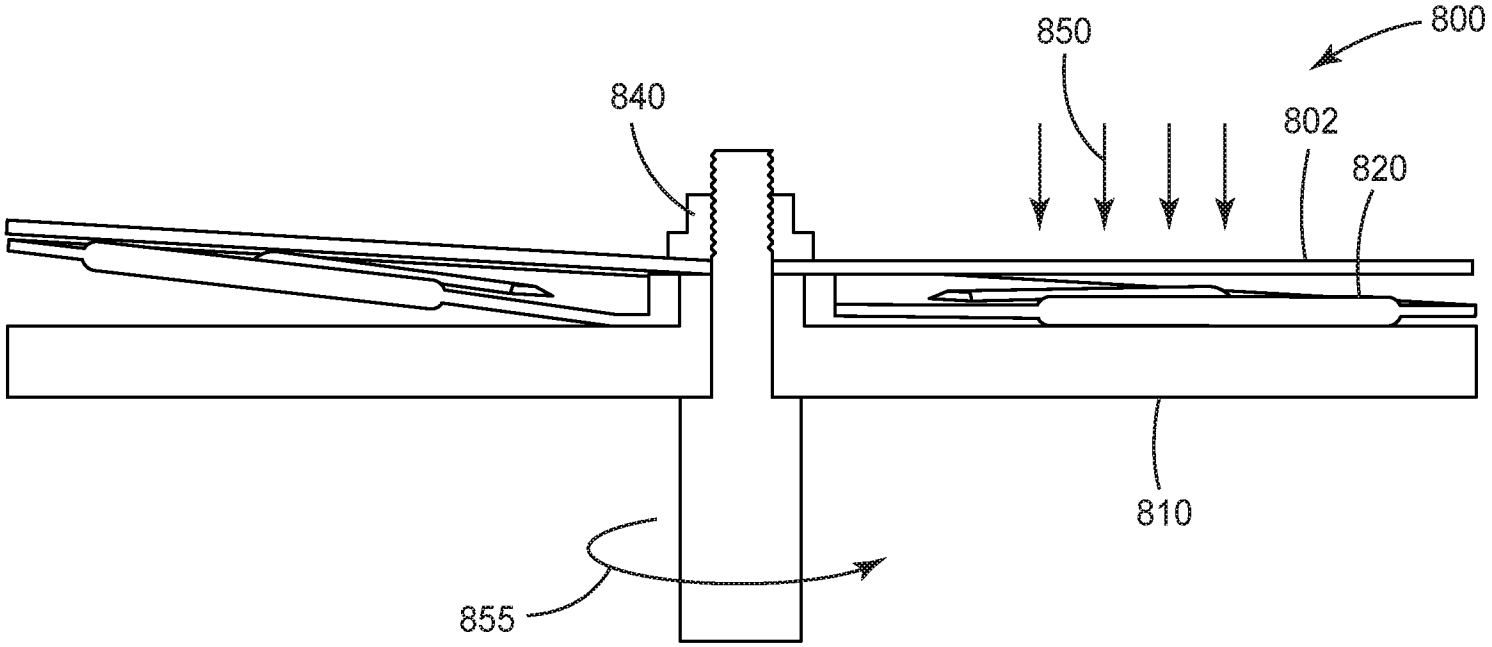

As illustrated in FIG. 8B, as grinding forces 850 are applied on a first area of abrasive disc 802, a corresponding first area of conical pressure pad 820 is depressed against back-up plate 810. However, because conical pressure pad 820 has a greater circumference and surface area than disc 802 and backup plate 810, because of its conical geometry, it will naturally precess forward as assembly 800 rotates in direction 855. Conical pressure pad 820 has raised features, such as raised features 412 or features 312, which have an initial relative position with respect to abrasive disc 802 at a first point of operation and, during grinding, have a second relative position with respect to abrasive disc 802 as a result of grinding forces.

The height of a cone formed by conical bump pad 820 is small, for example on the order of 1-5 mm, depending on the application and the size of abrasive disc 802. Conical pressure pad, in some embodiments, is free to rotate freely between the abrasive disc 802 and backup plate 810. It may have a clearance hole in the center that goes around a protrusion in the backup plate 810, as illustrated in FIG. 8A. Conical pressure pad 820 includes raised features that transmit the grinding forces to the abrasive disc 802 in higher and lower pressure areas.

As illustrated in FIG. 8B, during a grinding operation, the side of conical pressure pad 820 will pop up slightly (exaggerated in FIG. 8B for understanding purposes) because its conical shape does not allow for it to be in contact with the entire planar surface of backup plate 810. This causes conical pressure pad to continuously deform to stay mostly flat where the grinding forces are applied, but because its radial path length (at any radius) is slightly longer than the radius of backup plate 810 and abrasive disc 802, it will precess slowly around, changing the relative location of raised features on its surface with respect to abrasive disc 802.

Figure 8C:
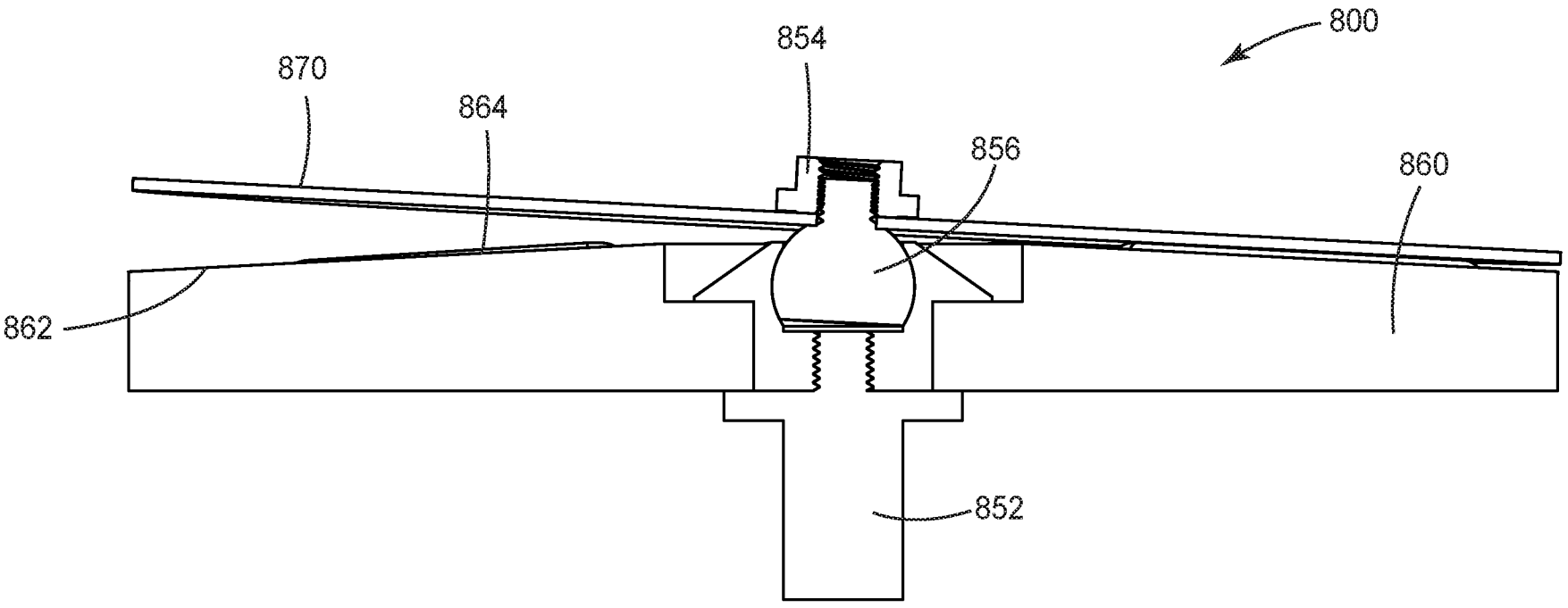

Another embodiment is illustrated in FIG. 8C, where the features of the conical pressure pad are incorporated into a backup plate 860, which has a conical surface 862 and raised features 864. Assembly 850 then includes a grinding disc 870 that is attached to a spherical bearing 856 by drive shaft 852 and fastener 854, which allows disc 870 to pivot and precess slowly around back-up pad 860, changing a relative position of disc 870 with respect to a raised feature 864 each time contact is made.

An advantage of removing the raised features from a back-up pad or back-up plate 810, as illustrated in FIGS. 8D-8G, is the ability to have raised features extending from both sides of a pressure pad. This can be done using a single molded part or by molding the raised features onto a spring steel sheet. Even in embodiments where the conical nature of the pressure pad is small or nonexistence, the presence of raised features on both sides of the pressure pad should provide enough strength to "pop up" when grinding forces are removed, and that popping motion should move it randomly so the raised features move slightly each time you the assembly is used to grind.

In the embodiment of FIG. 8C, drive shaft 852 drives base pad 860, leaving the abrasive disk 870 free to rotate, with enough friction so the abrasive disk normally wants to move with the conical base pad 870 when the grinder starts, but low enough friction so it can still rotate relative to base pad 860 when it experiences grinding forces.

FIG. 8D-8G illustrate another embodiment where precession can occur, but where a conical shaped pad is not needed. Instead, a pressure pad 950 in an assembly 900 has a plurality of pressure features 910. Each pressure feature 910 is connected to adjacent pressure features 910, in one embodiment, by a connector 912. While connector 912 is illustrated as substantially orthogonal to pressure features 910, it is expressly contemplated that, in some embodiments, connector 912 is more aggressively angled with respect to pressure features 910. For example, the angle may be an obtuse angle, at least 95°, or at least 100°, or at least 105%, or at least 100°, or at least 105°, or at least 110°, or at least 115°, or at least 120°, or at least 125°, or greater. Additionally, the angle may be an acute angle, less than 85°, less than 80°, less than 75°, less than 70°, less than 65°, less than 60°, less than 55°, less than 50° or lower. In some embodiments, connector 912 has a length that is longer than a distance between adjacent pressure features, which may cause. adjacent pressure features to, be at separate heights relative to a backup plate. For example, one may be in contact with an abrasive disc 902 while an adjacent feature is only in contact with backup plate 920.

Figure 8D:
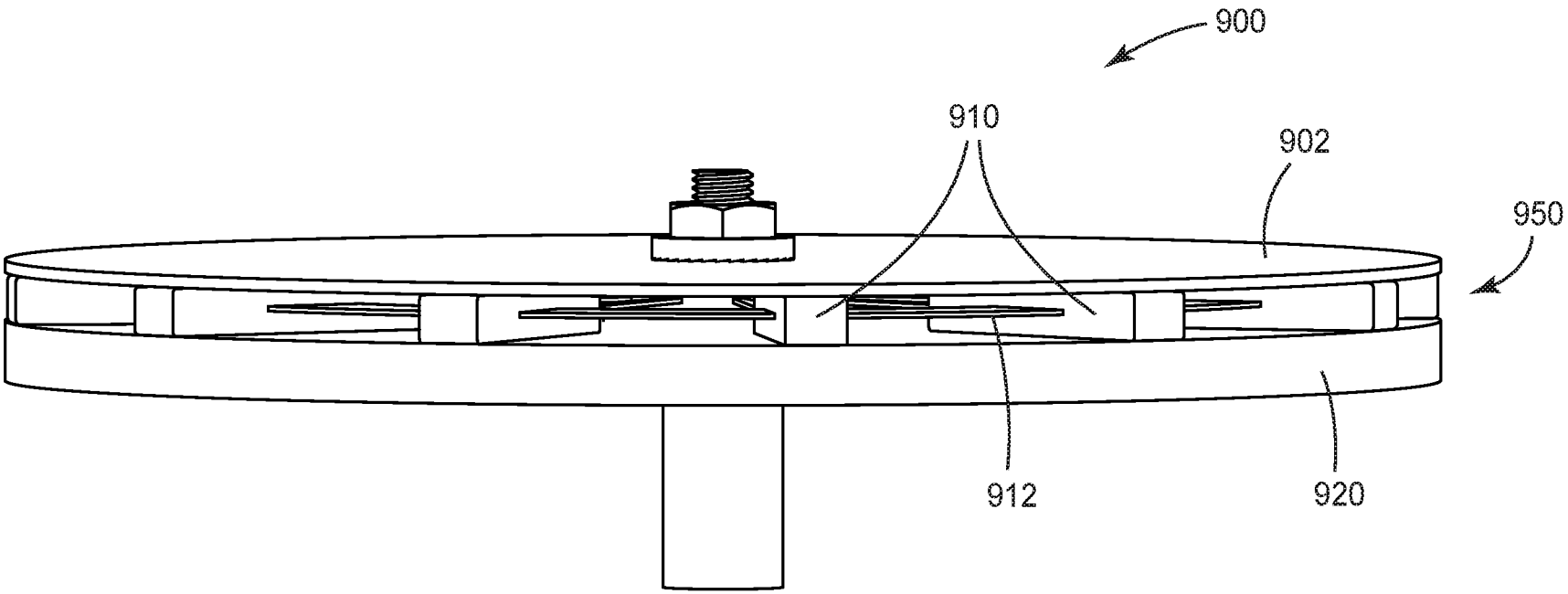
Figure 8E:
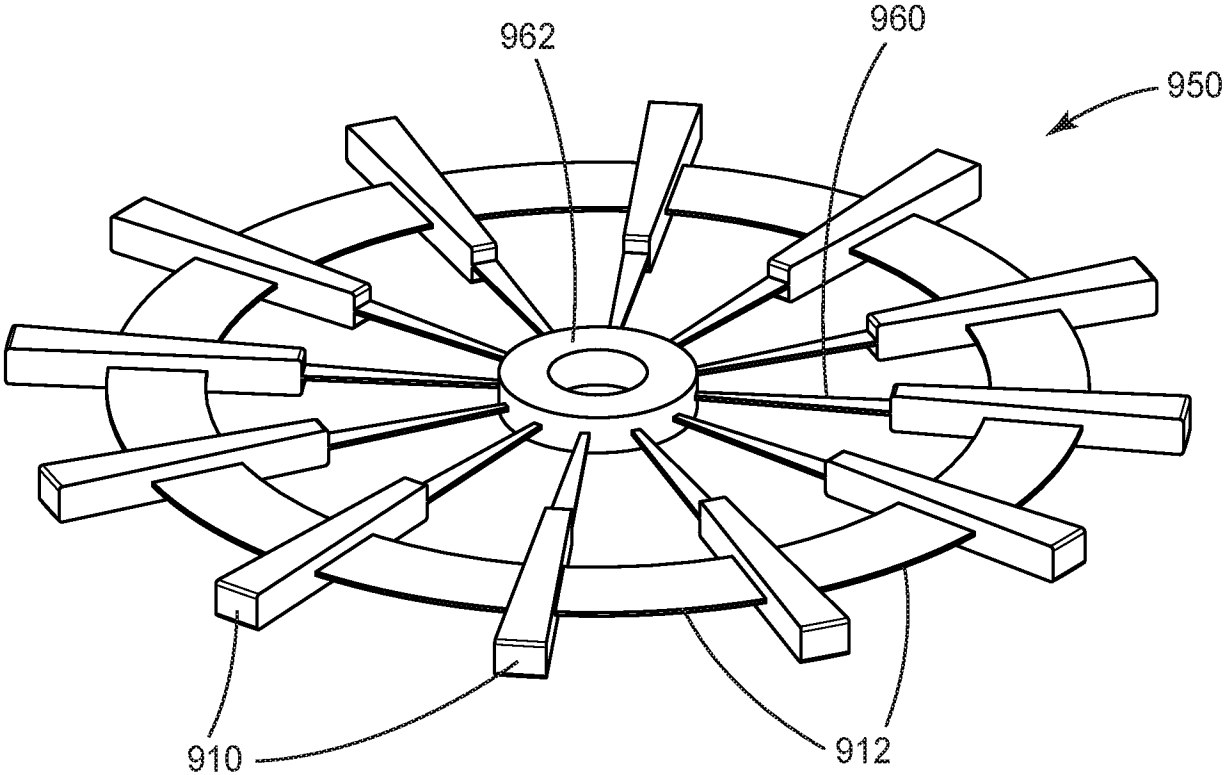

FIG. 8E illustrates a perspective view of a pressure pad 950. Pressure features 910, as illustrated in FIG. 8E are coupled to a center ring 962 by a plurality of connectors 960. In the embodiment of FIG. 8E, pressure features 910 extend substantially perpendicularly outward from a point on center ring 962. This is in contrast with pressure features 970 and 975 of FIGS. 8F and 8G which spiral away from a center ring 975.

Figure 8F:
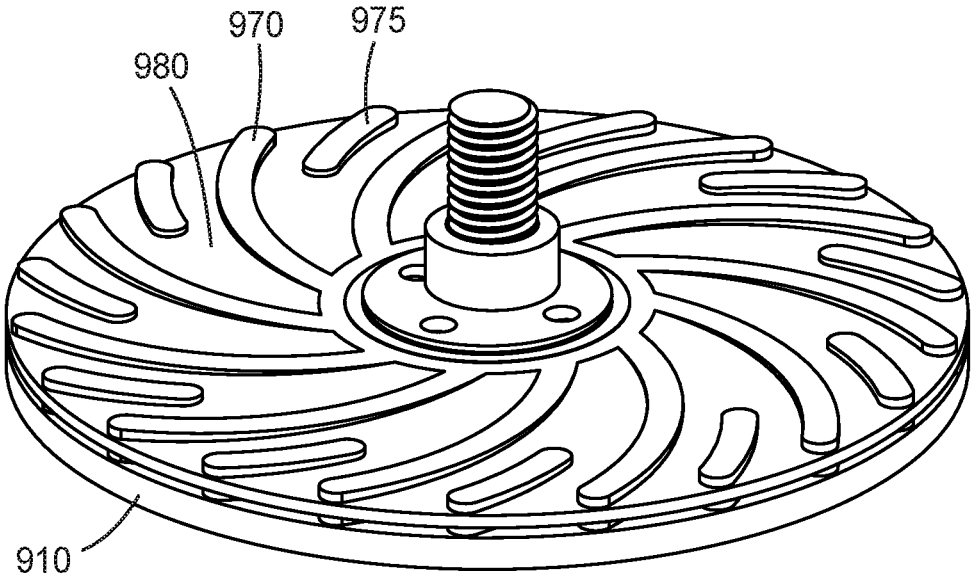

As illustrated in FIG. 8F, in some embodiments, a pressure pad 980 may include pressure features 970, 975 that extend from both sides of pad 980, on the side of backup plate 920 as well as the abrasive disc contacting side.

Figure 8G:
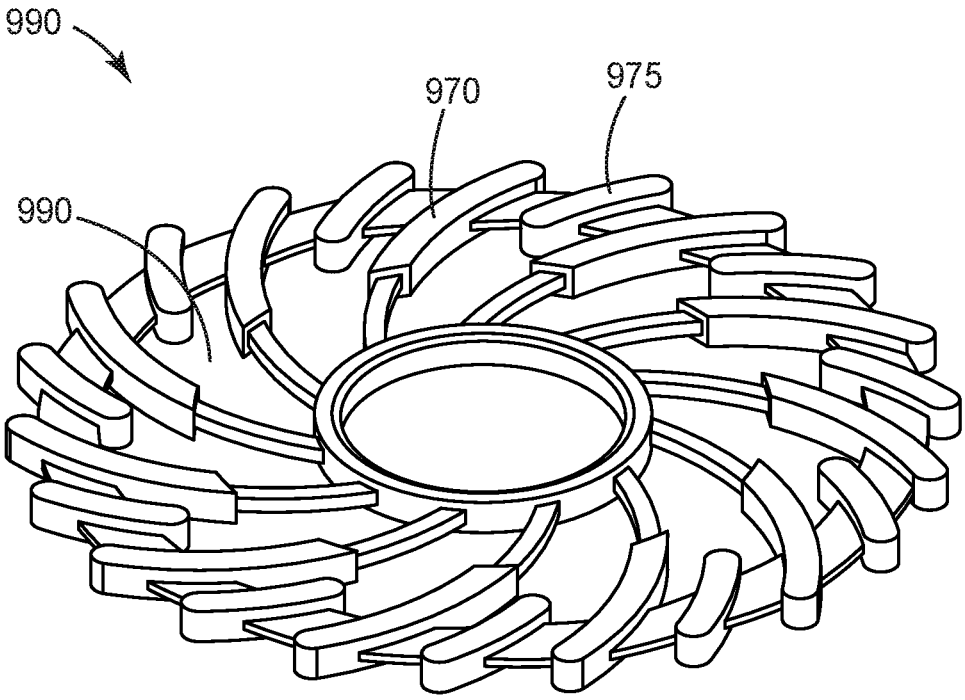

As illustrated in FIGS. 8D and 8G, it is contemplated that, in some embodiments, a pressure pad 920 includes gaps 990, which may facilitate precession of pressure features 970, 975 about a drive shaft.

Embodiments illustrated in FIGS. 8A-8G may also provide the additional benefit might be additional cooling airflow obtained by adding space between the abrasive disk and a base pad. As described herein, when one region of a pressure pad is pressed down during grinding, then other regions of the Conical Bump Pad will either pop up or spread out.

As the Base Support rotates, either one of two things will happen, depending on the material properties and the forces and speeds. The pressure pad may be compressed in one region at a time and the abrasive disc will effectively rotate very slowly relative to the base support, e.g. will precess. This precession can be further understood by looking at the total path length around a circular path for the abrasive disc at a given radius and the total path length around a circular path for the pressure pad.

For example, assuming a disc has a 2" radius, the path around the abrasive disc is:

$$\text{Path} = \pi * 2(r) == \pi^{*}2^{*}2 = 4\pi \qquad \text{Equation 1}$$

In contrast, the distance around a conical pressure pad when it is pressed flat against the base support is:

$$\text{Path} = 2\pi r = 2\pi\left(\frac{2}{\cos(\theta)}\right)^2 \qquad \text{Equation 2}$$

which, for a 2.8° slope, for example, produces (4.01) 7E. Therefore, a region of the abrasive will not be in contact with the same exact region of the pressure pad after one revolution. The slope may be higher or lower, depending on the desired precession. The slope may, for example, be as low as about 1°, or 2°, or may be about 3°, or about 4°, or about 5°.

Alternatively, if the pressure pad buckles, or does not flex properly to enable the precession, it will still lift the abrasive disc up and away from the base pad each time that force is removed, and this will cause all pressure features to randomly relocate themselves slightly.

Referring back to FIG. 6, the embodiments of FIG. 8 provide a similar effect to ribs being moved by a user, but the movement is provided continuously during operation of the grinding tool, and on a movement scale substantially imperceptible to a user.

As described herein, some embodiments illustrate a hub with a backup plate attached to the hub, for example FIG. 1C. Other embodiments, such as FIG. 1B, illustrate a single back-up pad assembly 110. It is expressly contemplated that these designs are interchangeable, and that each embodiment described in FIGS. 1-8 could conceivably operate with a replaceable backup plate attached to a hub or with a replaceable back-up pad.

Figure 9A:
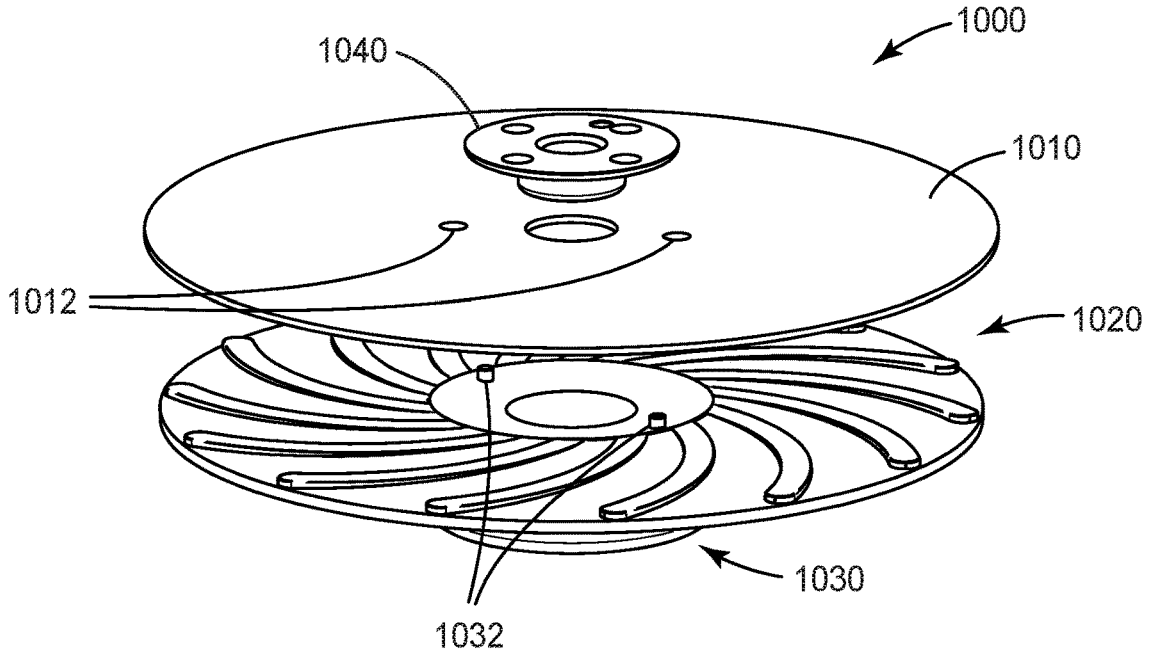
FIGS. 9A-9E illustrate complimentary locking assemblies for an abrasive assembly in accordance with embodiments herein.

FIGS. 9A-F illustrate complimentary locking assemblies for an abrasive assembly in accordance with embodiments herein. FIG. 9A illustrates a perspective exploded view of an assembly 1000 includes an abrasive disc 1010 that couples to a backup pad assembly 1024, which may be any of the backup assemblies described herein, or another suitable backup pad assembly. A driveshaft component 1030 may have one or more locking features 1032 that can interact with a corresponding receiving feature 1012. In some embodiments, back-up pad 1020 also includes corresponding receiving features. However, for embodiments where slippage or movement of backup pad 1020 is needed, e.g. as in FIG. 8, backup pad does not interact with locking features 1032 or receiving features 1012.

Figure 9B:
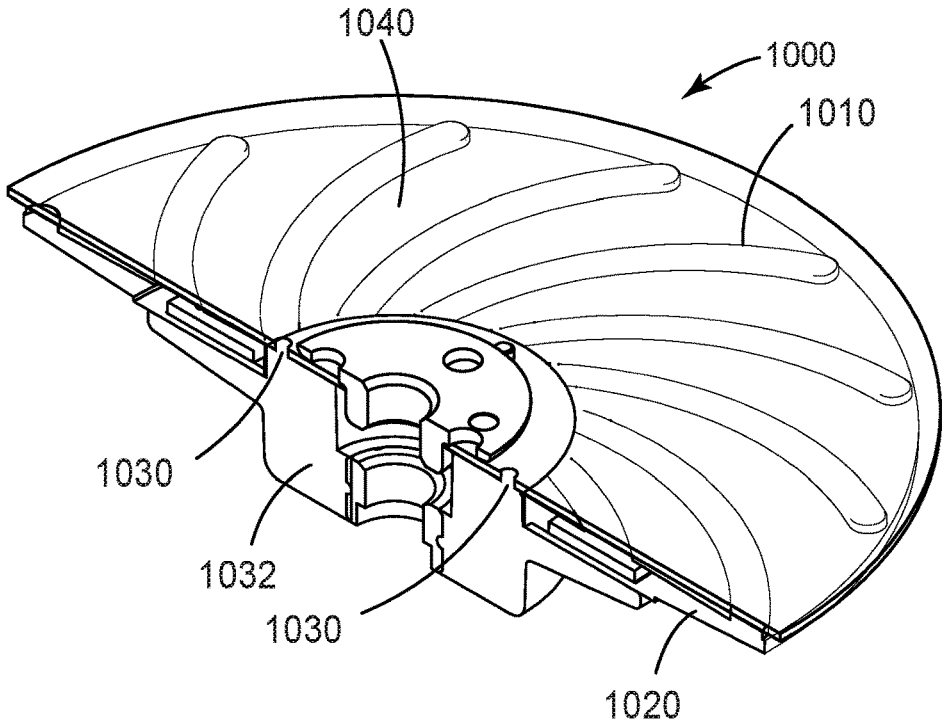

Locking features 1032, in the illustrated embodiment of FIGS. 9A and 9B, are protrusions extending up from a drive-shaft engaging component 1030. FIG. 9B illustrates a cutaway view of assembly 1000. As illustrated, a fastener 1040 couples to a driveshaft receiving component 1030 such that locking components 1032 engage with receiving features 1012.

Locking features 1032 may be protrusions received by corresponding apertures, as illustrated in FIGS. 9A and 9B, however other options are expressly contemplated. For example, drive shaft engaging component 1030 may engage with fastener 1040 through abrasive disc 1010, for example such that protrusions 1032 are received in apertures located within fastener 1040.

Figure 9C:
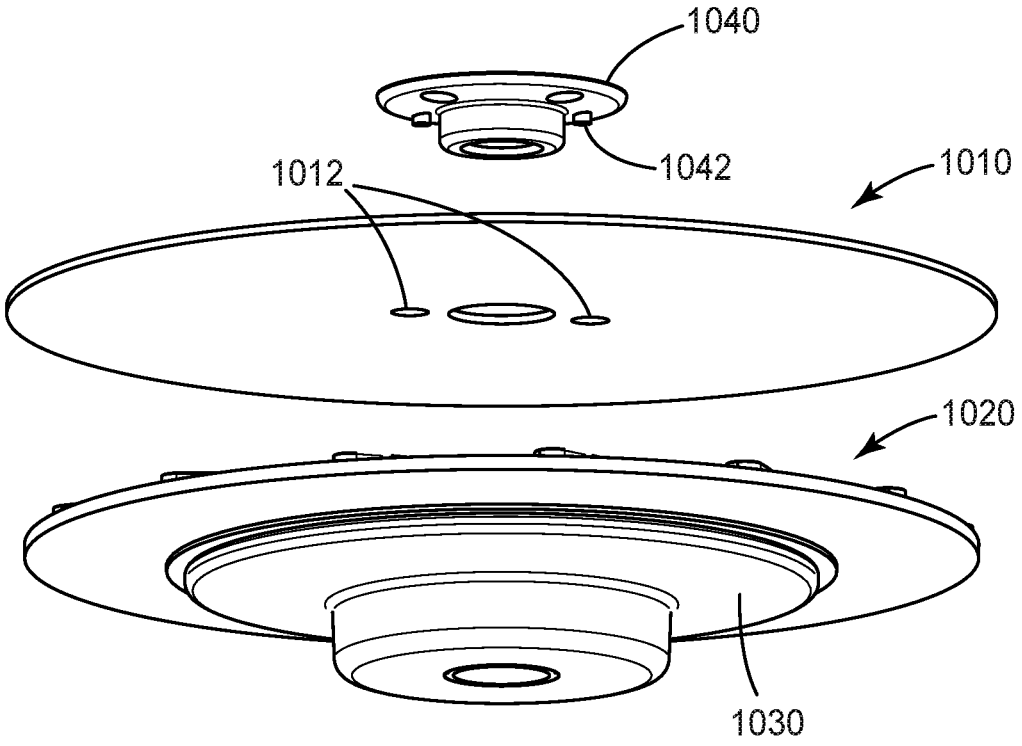
Figure 9D:
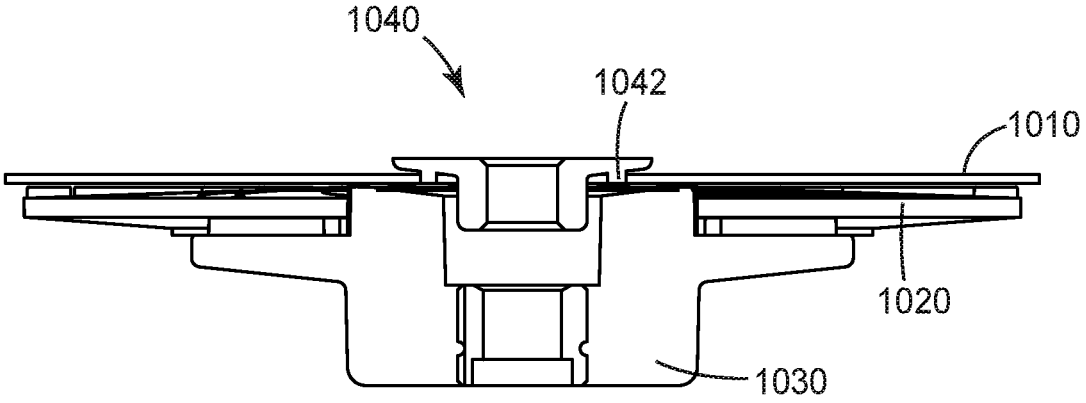

Alternatively, as illustrated in the embodiment of FIGS. 9C and 9D, instead of the locking features extending from a drive shaft component 1030, toward fastener 1040, the locking features 1042 may extend toward drive shaft component 1030, from fastener 1040.

Figures 1, 9E:
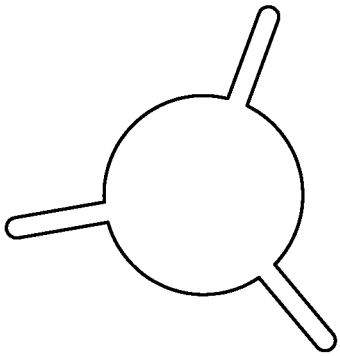
Figures 2, 9E:
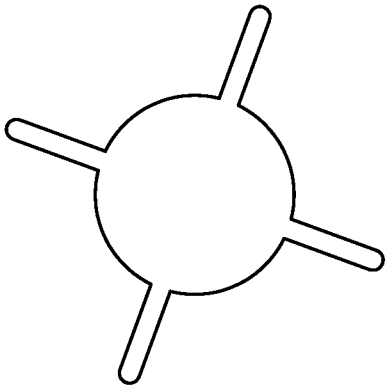
Figures 3, 9E:
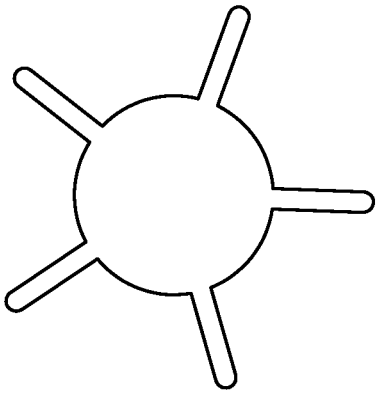
Figures 4, 9E:
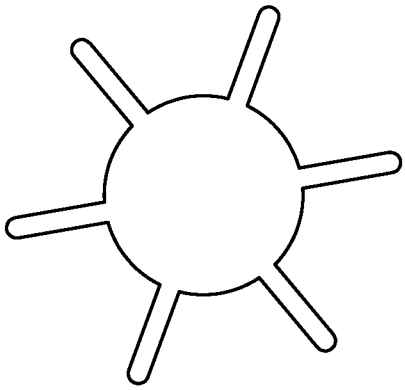
Figures 5, 9E:
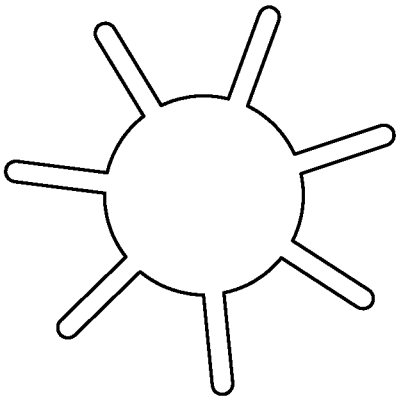
Figures 6, 9E:
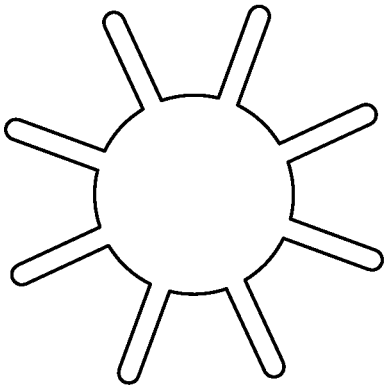

While FIGS. 9A-9D illustrate locking features 1032 as cylindrical protrusions received by circular apertures, it is expressly contemplated that other shapes may be used, or even preferred. For example, ovals, quadrilaterals, stars, crescents, or other polygons. Additionally, slotted shapes may be used, as illustrated in FIGS. 9E-1-9E-6 which illustrate, respectively, a 3-slotted aperture, a 4-slotted aperture, a 5-slotted aperture, a 6-slotted aperture, a 7-slotted aperture, or an 8-slotted aperture. More, or fewer, slots may be present in other embodiments. The number of slots may also be used to provide an indication to a customer of a backup pad type or backup pad features.

While two locking features 1032 are illustrated, more or fewer may be present. For example, only one protrusion may be present on a backup pad. However, in some embodiments herein, at least one locking feature is present on an abrasive article, positioned off-center from a drive-shaft receive aperture, that interacts with a corresponding feature on either a backup pad or a drive shaft receiving feature.

FIG. 9F illustrates another embodiment of a locking feature. FIG. 9F illustrates a perspective exploded view of an assembly 1100 includes an abrasive disc 1110 that couples to a backup pad assembly 1120, which may be any of the backup assemblies described herein, or another suitable backup pad assembly. A driveshaft component 1140 couple to a driveshaft. In some embodiments, back-up pad 1120 also includes a raised feature 1130 about which an inner circumference 1150 of abrasive disc 1110 is sized to fit. Raised feature 1130 may be a ridge extending about a feature circumference, as illustrated in FIG. 9F. Alternatively, in some embodiments, raised feature 1130 is formed from a series of protrusions arranged in a pattern to receive an interior edge 1150 of abrasive article 1110. For example, a series of bumps, ridges, or protrusions may be arranged in a shape that matches interior edge 1150.

In practice of methods according to the present disclosure, repositioning of the abrasive disc relative to the raised projection of the back-up pad may be repeated any desired number of times. The methods may be practiced manually, automatically, robotically, or a combination thereof.

The preceding description, given in order to enable one of ordinary skill in the art to practice the claimed disclosure, is not to be construed as limiting the scope of the disclosure, which is defined by the claims and all equivalents thereto.

Some embodiments herein provide systems that, upon operator engagement, cause some rotation of the back-up pad with respect to the abrasive disc, causing features to interact with a new area of the abrasive disc. Other embodiments herein provide systems that, during an abrasive operation or between abrasive operations, will automatically adjust a relative position of an abrasive article with respect to a back-up pad. Some embodiments herein cause relative positions of the back-up pad and the abrasive article to change in discrete increments. Other embodiments herein allow for continuous, or non-discrete, incremental changes between the back-up pad and the abrasive article.

A method for repositioning an abrasive disc within a repositionable abrasive disc mounting assembly is presented. The method includes mounting the abrasive disc to a repositionable abrasive disc mounting assembly in a first position. The mounting disc assembly includes the abrasive disc coupled to the back-up pad assembly such that the abrasive disc is in contact with a pressure feature of the back-up pad assembly, a drive shaft of a grinding tool, and a fastener that maintains the position of the abrasive disc and the back-up pad coupled to the drive shaft. The method also includes conducting an abrasive operation by activating the grinding tool. The method also includes re-positioning the abrasive disc, with respect to the repositionable abrasive disc mounting assembly, in a second position. The first position includes the abrasive disc in a first position relative to the pressure feature. The second position includes the abrasive disc in a second position relative to the pressure feature assembly. Re-positioning includes an adjustment between the first and second position while the abrasive disc is still positioned on the drive shaft between the fastener and the back-up pad assembly.

The method may be implemented such that the pressure feature is a first pressure feature. The back-up pad assembly includes a plurality of pressure features configured to create high pressure areas on the abrasive disc during the abrasive operation.

The method may be implemented such that the back-up pad assembly includes a rib plate. The plurality of pressure features are a plurality of ribs extending from a central ring of the rib plate. At least one of the plurality of ribs includes a tab that extends beyond an outer circumference of the abrasive disc. Re-positioning includes an operator applying force to the tab to rotate the rib plate with respect to the abrasive disc.

The method may be implemented such that the back-up pad assembly further includes: a scape lever assembly comprising a scape lever configured to interact with a first gear tooth and a second gear tooth on a scape gear. The scape lever moves from the first gear tooth to a second gear tooth automatically during acceleration or deceleration of the back-up pad assembly during an abrasive operation.

The method may be implemented such that the scape gear includes a fastener.

The method may be implemented such that the scape lever assembly further includes a spring to bias the scape lever.

The method may be implemented such that the scape lever includes a flexure member.

The method may be implemented such that the back-up pad assembly further includes a back-up plate and a radial extender biased between the drive shaft and the back-up plate. The radial extender moves from a first extender position when the abrasive disc mounting assembly is in the first position, to a second extender position when the abrasive disc mounting assembly is in the second position.

The method may be implemented such that the radial extender extends from the drive shaft.

The method may be implemented such that the radial extender extends from the back-up pad toward the drive shaft.

The method may be implemented such that the radial extender engages a friction surface.

The method may be implemented such that the radial extender is received by a receiving feature.

The method may be implemented such that it also includes a plunger assembly that, when actuated, causes the re-positioning.

The method may be implemented such that the plunger assembly includes a plunger coupled to a stop member, wherein a spring force biases the plunger away from the stop member, and wherein an application of a force higher than the spring force actuates the plunger assembly.

The method may be implemented such that the stop member is also coupled to a rotating feature. Actuation of the plunger assembly causes the rotating feature to switch between a first coupling configuration, in the first position, and a second coupling configuration, in the second position.

The method may be implemented such that the back-up pad assembly further includes a planetary gear assembly, and wherein the planetary gear assembly includes a sun gear coupled to a plurality of planet gears by a carrier and a ring gear that engages the planetary gears, and wherein the abrasive disc is coupled to the planetary gear assembly, and wherein a pressure feature is coupled to a different one of the sun, planetary and ring gears than the abrasive disc.

The method may be implemented such that the back-up pad assembly includes a pressure pad free floating between a back-up pad plate and the abrasive disc. The pressure pad includes a pressure feature extending on a surface of the pressure pad. The pressure feature is configured to impart pressure on the abrasive disc during the abrasive operation.

The method may be implemented such that the pressure pad is conical in shape such that it does not fully engage both a bottom surface of the abrasive disc and a top surface of the back-up pad plate.

The method may be implemented such that the pressure feature is configured to reversibly compress during a grinding operation.

The method may be implemented such that the abrasive operation includes applying torque to the driveshaft of the grinding tool, engaging the abrasive disc to a worksurface, applying force to the abrasive disc, removing force from the abrasive disc, and removing the applied torque from the driveshaft. Re-positioning occurs automatically during one of the steps of the abrasive operation, and wherein the steps of applying torque, engaging, applying force, removing force and removing the applied torque are repeated during the abrasive operation. Re-positioning occurs during the same one step each time the steps are repeated.

The method may be implemented such that it also includes conducting a second abrasive operation by activating the grinding tool, and repositioning the abrasive disc to the repositionable abrasive disc mounting assembly in a third position. The third position includes the abrasive disc in a third position relative to the back-up pad assembly. A first difference between the first and second positions is the same as a second distance between the second and third positions.

The method may be implemented such that it also includes conducting a second abrasive operation by activating the grinding tool and re-positioning the abrasive disc to the repositionable abrasive disc mounting assembly in a third position. The third position includes the abrasive disc in a third position relative to the back-up pad assembly. A first difference between the first and second positions is different than a second distance between the second and third positions.

The method may be implemented such that the re-positioning from the first to the second position occurs during an acceleration, and re-positioning from the second position to the third position happens during deceleration.

The method may be implemented such that the back-up pad assembly includes a backup plate coupled to a backup hub.

A back-up pad assembly for mounting on a drive shaft of a power tool is presented. The back-up pad assembly includes a back-up plate assembly having pressure engaging feature that engages a first area of an abrasive disc and a movement feature configured to cause the pressure engaging feature to move from the first area of an abrasive disc to a second area of the abrasive disc in response to an applied grinding force.

The back-up pad assembly may be implemented such that the movement feature is a conical surface of the back-up plate.

The back-up pad assembly may be implemented such that it also includes a spherical bearing that couples to the abrasive disc and facilitates precession of the abrasive disc about the back-up plate during operation.

The back-up pad assembly may be implemented such that the movement feature includes a pressure pad separate from a back-up pad plate. The pressure pad is positioned between the abrasive disc and the back-up plate on the drive shaft.

The back-up pad assembly may be implemented such that the pressure feature is one of a plurality of pressure features.

The back-up pad assembly may be implemented such that each of the plurality of pressure features is coupled to an adjacent pressure feature by an angled connector.

The back-up pad assembly may be implemented such that the pressure pad includes a plurality of open spaces between adjacent pressure features.

The back-up pad assembly may be implemented such that the pressure features are curved.

The back-up pad assembly may be implemented such that the pressure features are elastically compressible.

The back-up pad assembly may be implemented such that the plurality of pressure features include a first plurality of pressure features, each having a first length, and a second plurality of pressure features, each having a second length, and wherein the first and second lengths are different.

A back-up pad assembly for mounting on a drive shaft of a power tool is presented. The back-up pad assembly includes a back-up plate assembly having pressure engaging feature that engages a first area of an abrasive disc and a movement feature configured to, without operator engagement, cause the pressure engaging feature to move from the first area of an abrasive disc to a second area of the abrasive disc during an abrasive operation.

The back-up pad assembly may be implemented such that the abrasive operation includes powering up the power tool, powering down the power tool, engaging a worksurface with the abrasive disc, disengaging the abrasive disc from the worksurface, and abrading the worksurface with the abrasive disc.

The back-up pad assembly may be implemented such that the movement feature is coupled to the drive shaft of the power tool.

The back-up pad assembly may be implemented such that the movement feature includes a planetary gear assembly, and wherein the abrasive disc is coupled to a first gear, wherein the pressure engaging feature is attached to a second gear, and wherein each of the first and second gears are differently selected from the group consisting of: a sun gear, a connector, and a ring gear.

The back-up pad assembly may be implemented such that the movement feature includes a scape lever assembly, and wherein the scape lever assembly include a scape lever configured to interact with a first gear tooth and a second gear tooth on a scape gear. The scape lever moves from the first gear tooth to a second gear tooth automatically when the abrasive disc disengages from a worksurface.

The back-up pad assembly may be implemented such that the movement feature includes a radial feature biased between the drive shaft of the power tool and an interior surface of the back-up plate assembly.

The back-up pad assembly may be implemented such that the radial feature extends from the drive shaft and engages the interior surface of the back-up plate assembly.

The back-up pad assembly may be implemented such that a biasing force is provided by a spring.

The back-up pad assembly may be implemented such that the radial feature is urged into a receiving indentation in the back-up plate assembly.

The back-up pad assembly may be implemented such that the interior surface is a friction surface.

The back-up pad assembly may be implemented such that the radial feature extends from the back-up plate assembly and engages an exterior surface of the drive shaft.

The back-up pad assembly may be implemented such that a biasing force is provided by a spring.

The back-up pad assembly may be implemented such that the radial feature is urged into a receiving indentation in the back-up plate assembly.

The back-up pad assembly may be implemented such that the drive shaft includes a friction surface.

The back-up pad assembly may be implemented such that the movement feature includes a precession inducing feature. The precession inducing feature is selected from the group consisting of: a conical back-up plate, a conical pressure plate, or a pressure pad with a plurality of elastically compressible pressure features.

The back-up pad assembly may be implemented such that the back-up plate assembly includes a back-up plate and a hub that couples the back-up plate to the drive shaft.

A back-up pad assembly is presented that includes a back-up plate assembly having a pressure engaging feature that engages a first area of an abrasive disc and a movement feature configured to, when actuated by an operator of a power tool in between grinding operations, cause an engagement of the pressure engaging feature to change from a first area of an abrasive disc to a second area of the abrasive disc.

The back-up pad assembly may be implemented such that the movement feature includes a rib plate positioned between the back-up plate assembly and the abrasive disc. The rib plate includes a plurality of ribs and a tab on one of the plurality of ribs that extends beyond an outer edge of the back-up pad assembly. A force applied by an operator to the tab moves the rib plate such that an area of experienced high pressure on the abrasive disc changes from a first area to a second area.

The back-up pad assembly may be implemented such that the tab is substantially perpendicular to a plane comprising the plurality of ribs.

The back-up pad assembly may be implemented such that the plurality of ribs includes at least four ribs.

The back-up pad assembly may be implemented such that the plurality of ribs are evenly spaced about the drive shaft.

The back-up pad assembly may be implemented such that the plurality of ribs are curved.

The back-up pad assembly may be implemented such that the movement feature includes a plunger assembly coupled to a disc rotation assembly, wherein actuation of the plunger assembly causes the disc rotation assembly to change the engagement of the pressure engaging feature from the first area to the second area.

The back-up pad assembly may be implemented such that the disc rotation assembly couples to the abrasive disc, and wherein actuation of the plunger assembly causes a change in position of the abrasive disc.

The back-up pad assembly may be implemented such that the plunger assembly includes a plunger biased away from a stop member by a spring force, and wherein actuation includes the operator applying a force greater than the spring force to the plunger.

The back-up pad assembly may be implemented such that the plunger and the stop member are both coupled to a drive shaft.

The back-up pad assembly may be implemented such that the disc rotation assembly includes a rotation feature that engages an abrasive disc and also engages the stop member, and wherein actuation of the plunger causes the disc rotation assembly to disengage from the stop member, and wherein removal of the operator applied force causes the disc rotation assembly to re-engage the stop member.

The back-up pad assembly may be implemented such that the disc rotation assembly disengages from a first position relative to the stop member and re-engages in a second position relative to the stop member, and wherein the first and second positions are separated by a discrete distance.

The back-up pad assembly may be implemented such that movement from the first and second positions is facilitated by an angled portion on the plunger.

The back-up pad assembly may be implemented such that the spring force is a first spring force, and wherein a second spring force biases the rotation assembly away from the back-up plate assembly.

The back-up pad assembly may be implemented such that the disc rotation assembly includes a rotation feature and a washer, and wherein the abrasive disc is positioned on a drive shaft between the rotation feature and the washer.

What is claimed is:

1. A method for repositioning an abrasive disc within a repositionable abrasive disc mounting assembly, the method comprising:

mounting the abrasive disc to a repositionable abrasive disc mounting assembly in a first position, wherein the mounting disc assembly comprises:

the abrasive disc coupled to a back-up pad assembly such that the abrasive disc is in contact with a pressure feature of the back-up pad assembly;

a drive shaft of a grinding tool; and a fastener that maintains the position of the abrasive disc and the back-up pad coupled to the drive shaft;

conducting an abrasive operation by activating the grinding tool;

re-positioning the abrasive disc, with respect to the repositionable abrasive disc mounting assembly, in a second position, wherein the first position comprises the abrasive disc in a first position relative to the pressure feature and wherein the second position comprises the abrasive disc in a second position relative to the pressure feature; and wherein re-positioning comprises an adjustment between the first and second position while the abrasive disc is still positioned on the drive shaft between the fastener and the back-up pad assembly, and wherein a first repositioning comprises a first distance between the first position and the second position, and a second repositioning, between the second position and a third position, comprises a second distance different from the first distance.

2. The method of claim 1, wherein the pressure feature is a first pressure feature, and wherein the back-up pad assembly comprises a second pressure features, wherein the first and second pressure features are configured to create a first and a second high pressure areas on the abrasive disc during the abrasive operation.

3. The method of claim 1, wherein the back-up pad assembly comprises a pressure pad free floating between a back-up pad plate and the abrasive disc, and wherein the pressure pad comprises the pressure feature extending on a surface of the pressure pad, and wherein the pressure feature is configured to impart pressure on the abrasive disc during the abrasive operation.

4. A back-up pad assembly for mounting on a drive shaft of a power tool, the back-up pad assembly comprising:

a back-up plate assembly having pressure engaging feature that engages a first area of an abrasive disc; and a movement feature configured to, without operator engagement, cause the pressure engaging feature to move from the first area of an abrasive disc to a second area of the abrasive disc during a first actuation, wherein the movement feature actuates during an abrasive operation, and wherein the movement feature is further configured to, in a second actuation, move from the second area of the abrasive disc to a third area of the abrasive disc, wherein the first actuation comprises a first rotational distance, the second actuation comprises a second rotational distance, and wherein the first and second rotational distances differ.

5. The back-up pad assembly of claim 4, wherein the abrasive operation comprises powering up the power tool, powering down the power tool, engaging a worksurface with the abrasive disc, disengaging the abrasive disc from the worksurface, and abrading the worksurface with the abrasive disc.

6. The back-up pad assembly of claim 4, wherein the movement feature is coupled to the drive shaft of the power tool.

* * * * *